US011753241B2

(12) United States Patent
Yu

(10) Patent No.: US 11,753,241 B2
(45) Date of Patent: Sep. 12, 2023

(54) INTELLIGENT GARBAGE CAN

(71) Applicant: DREAME TECHNOLOGY (SHANGHAI) CO., LTD., Shanghai (CN)

(72) Inventor: Hao Yu, Shanghai (CN)

(73) Assignee: DREAME TECHNOLOGY (SHANGHAI) CO., LTD., Shanghai (CN)

( * ) Notice: Subject to any disclaimer, the term of this patent is extended or adjusted under 35 U.S.C. 154(b) by 0 days.

(21) Appl. No.: 17/730,175

(22) Filed: Apr. 26, 2022

(65) Prior Publication Data

US 2022/0250835 A1 Aug. 11, 2022

Related U.S. Application Data

(63) Continuation of application No. PCT/CN2020/140142, filed on Dec. 28, 2020.

(30) Foreign Application Priority Data

Dec. 31, 2019 (CN) ..... 201922459891.8
Dec. 31, 2019 (CN) ..... 201922459893.7
(Continued)

(51) Int. Cl.
*B65F 1/16* (2006.01)

(52) U.S. Cl.
CPC ..... *B65F 1/1638* (2013.01); *B65F 2210/168* (2013.01); *B65F 2210/181* (2013.01)

(58) Field of Classification Search
CPC ..... B65F 1/1638; B65F 2210/168; B65F 2210/1481
(Continued)

(56) References Cited

U.S. PATENT DOCUMENTS

2008/0264945 A1* 10/2008 Shek ..... B65F 1/1638 220/260
2010/0139071 A1* 6/2010 Wang ..... B65F 1/1607 29/426.1
(Continued)

FOREIGN PATENT DOCUMENTS

CN 201220831 Y 4/2009
CN 101891050 A * 11/2010 ..... B65F 1/1607
(Continued)

OTHER PUBLICATIONS

Huilai Li; "Chapter 4, Basic Principles of Plastic Parts Structure Design, Section 4.5, Reinforcing Rib Design of Plastic Parts"; Product Structure Design Example Tutorial—Introduction, Improvement, Mastery, Job Hunting; Jul. 2013; pp. 41-42; Publishing House of Electronics Industry; Beijing, China.

*Primary Examiner* — J. Gregory Pickett
*Assistant Examiner* — Niki M Eloshway
(74) *Attorney, Agent, or Firm* — Cheng-Ju Chiang

(57) ABSTRACT

An intelligent garbage can includes an end cover rack of which the interior is hollow and the middle portion is horizontally provided with a support; a first member of which the middle portion is hollow and which is provided above the support; and a second member of which the middle portion is hollow and which is provided below the support; wherein one side of the second member is provided with an arc-shaped connecting portion extending outwards in a radial direction, and the arc-shaped connecting portion is bent upwards to form an arc-shaped surface. According to embodiments of the present disclosure, the arc-shaped connecting portion is provided on the bottom surface of the end cover, so that the sealing of the connection position of a garbage can containing box and the end cover is enhanced, and user experience is improved.

20 Claims, 43 Drawing Sheets

(30) Foreign Application Priority Data

| | | |
|---|---|---|
| Dec. 31, 2019 | (CN) | 201922459905.6 |
| Dec. 31, 2019 | (CN) | 201922459947.X |
| Dec. 31, 2019 | (CN) | 201922468567.2 |
| Dec. 31, 2019 | (CN) | 201922468591.6 |
| Dec. 31, 2019 | (CN) | 201922468677.9 |

(58) Field of Classification Search
USPC ..... 220/62
See application file for complete search history.

(56) References Cited

U.S. PATENT DOCUMENTS

| | | | | |
|---|---|---|---|---|
| 2011/0074316 | A1* | 3/2011 | Shek | B65F 1/1607 318/3 |
| 2014/0117114 | A1* | 5/2014 | Muderlak | B65F 1/10 239/274 |
| 2014/0238986 | A1 | 8/2014 | Crawford et al. | |
| 2018/0229931 | A1* | 8/2018 | Shek | B65F 1/1638 |
| 2019/0055087 | A1* | 2/2019 | Wang | B65F 1/1638 |
| 2019/0382197 | A1 | 12/2019 | Li et al. | |
| 2021/0221610 | A1* | 7/2021 | Chen | B65F 1/1638 |
| 2021/0323762 | A1* | 10/2021 | Wang | B65F 1/08 |
| 2022/0097960 | A1* | 3/2022 | Yang | B65F 1/1646 |

FOREIGN PATENT DOCUMENTS

| | | | |
|---|---|---|---|
| CN | 101987690 | A | 3/2011 |
| CN | 105383835 | A | 3/2016 |
| CN | 105501752 | A | 4/2016 |
| CN | 206088012 | U | 4/2017 |
| CN | 206766831 | U | 12/2017 |
| CN | 108249076 | A | 7/2018 |
| CN | 208165803 | U | 11/2018 |
| CN | 109250350 | A | 1/2019 |
| CN | 209160585 | U | 7/2019 |
| CN | 209160587 | U | 7/2019 |
| CN | 209164493 | U | 7/2019 |
| CN | 209306141 | U | 8/2019 |
| CN | 209467619 | U | 10/2019 |
| CN | 209467631 | U | 10/2019 |
| CN | 209667895 | U | 11/2019 |
| CN | 211811515 | U | 10/2020 |
| CN | 211811516 | U | 10/2020 |
| CN | 212221255 | U | 12/2020 |
| CN | 212314531 | U | 1/2021 |
| CN | 212314532 | U | 1/2021 |
| EP | 3539902 | A1 | 9/2019 |
| JP | S57-59205 | U | 12/1982 |
| JP | S58-170882 | U | 11/1983 |
| JP | H2-138976 | U | 11/1990 |
| JP | 2002-104605 | A | 4/2002 |
| WO | 2021/136166 | A1 | 7/2021 |

* cited by examiner

INTELLIGENT GARBAGE CAN

CROSS-REFERENCE TO RELATED APPLICATION

This application is a bypass continuation of National Phase conversion of International (PCT) Patent Application No. PCT/CN2020/140142, filed on Dec. 28, 2020, which claims benefit of a Chinese Patent Application No. 201922468677.9, filed on Dec. 31, 2019, a Chinese Patent Application No. 201922459947.X, filed on Dec. 31, 2019, a Chinese Patent Application No. 201922468591.6, filed on Dec. 31, 2019, a Chinese Patent Application No. 201922459905.6, filed on Dec. 31, 2019, a Chinese Patent Application No. 201922459893.7, filed on Dec. 31, 2019, a Chinese Patent Application No. 201922459891.8, filed on Dec. 31, 2019, and a Chinese Patent Application No. 201922468567.2, filed on Dec. 31, 2019, the entire content of which is incorporated herein by reference.

TECHNICAL FIELD

The present application relates to a field of intelligent devices, in particular to an intelligent garbage can.

BACKGROUND

In the field of intelligent garbage cans, it is well known to use different structural forms of end cap devices to seal garbage cans. However, in the prior art, there is a gap at the connection between the end cap device and a garbage receiving area of the garbage can, which is not tight enough, thereby causing the smell of garbage in the garbage can to emanate and affect the user experience.

In addition, when the environment is relatively dark, the amount of the garbage can will make people uncertain, resulting in the phenomenon of garbage overflow.

Secondly, it is well known to use ventilation devices of different structures to achieve the ventilation of garbage cans. However, in the prior art, the vents are disposed on a side wall of the garbage can. Although smooth ventilation in the garbage can could be achieved, during the ventilation process, external dust will also fall into the inside of the garbage can and cause pollution, which is not easy to clean.

Thirdly, in the existing intelligent garbage cans, connection devices of different structural forms are usually used to realize the flip-up function of the garbage can. However, in the prior art, there are many lines inside the garbage can, which is prone to entanglement, causing the garbage can to be stuck. The connection device is integrally formed with a main body of the garbage can and cannot be disassembled, and its function is only to realize the connection function of the connection device, resulting in a waste of space.

On another hand, in the prior art, intelligent garbage cans usually use snap devices with different structural forms to limit the position of the end mechanisms of the garbage cans. However, when the end mechanism of the existing intelligent garbage can is turned up, it is easy to collide with a lower accommodating box. Over time, the end mechanism will be worn, which will shorten the life of the intelligent garbage can. The end mechanism of the intelligent garbage can is equipped with components such as automatic driving devices, which increases the weight of the end mechanism and increases the bearing strength of a connecting portion when it is turned up.

On another hand, in the prior art, the intelligent garbage can adopt different structural forms of holding devices to implement the installation of the conveyor belt. However, the existing conveyor belt only relies on the support of a fixed point to realize that the conveyor belt is fixed in the garbage can, which will cause the conveyor belt to shake during movement, thereby affecting the smoothness of the running position. Secondly, in the long run, the service life of the conveyor belt will be reduced, resulting in waste.

On another hand, in the prior art, positioning devices with different structural forms are usually used to realize the installation and positioning of the internal structure of a garbage can. However, a main body of the existing positioning mechanism is generally a cylinder, and a cross rib is provided and fixed inside. The function of the positioning mechanism is meaningless after the internal structure is installed, and an internal space is also occupied.

SUMMARY

The present application provides an end cap device, a lighting device, a ventilation device, a connecting device, a snap device, a holding device, a positioning device, and an intelligent garbage can, so as to solve the above-mentioned technical problems.

According to a first aspect of the present application, an end cap device is provided, including:

an end cap frame, an interior of the end cap frame being hollow, a middle portion of the end cap frame being horizontally provided with a bracket;

a first member, a middle of the first member being hollow, the first member being disposed above the bracket; and a second member, a middle of the second member being hollow, the second member being disposed below the bracket, one side of the second member being provided with an arc-shaped connecting portion extending radially and outwardly, the arc-shaped connecting portion being bent upwardly to form an arc-shaped surface.

According to a second aspect of the present application, an intelligent garbage can is provided, including the end cap device described in the first aspect of the present application.

According to the embodiments described in the first aspect and the second aspect of the present application, by providing the arc-shaped connecting portion on the bottom surface of the end cap, the sealing performance of the connection between an accommodating box of the garbage can and an end cap can be enhanced, thereby improving the user experience.

According to a third aspect of the present application, a lighting device is provided, including:

an end cap frame, an interior of the end cap frame being hollow, and a middle portion of the end cap frame being horizontally provided with a separation layer;

a first member, a middle of the first member being hollow, the first member being disposed above the separation layer;

a second member, a middle of the second member being hollow, the second member being disposed below the separation layer; and a lighting assembly, the lighting assembly being disposed on a lower end face of the second member;

wherein the end cap frame, the first member and the second member are disposed coaxially from top to bottom in sequence.

According to a fourth aspect of the present application, an intelligent garbage can is provided, including the lighting device described in the third aspect of the present application.

According to the embodiments described in the third aspect and the fourth aspect of the present application, the amount of the garbage can be determined by improving the brightness inside the garbage can as much as possible; and by having a real-time induction mechanism to achieve lighting when needed, and no lighting at other times, light pollution can be reduced.

According to a fifth aspect of the present application, a ventilation device is provided, including:

an accommodating box; and an outer casing disposed on one side of the accommodating box;

wherein the accommodating box is fixedly connected to an equipment box, and a bottom surface of the outer casing is provided with a plurality of mesh holes disposed in an array.

According to a sixth aspect of the present application, an intelligent garbage can is provided, including the ventilation device described in the fifth aspect of the present application.

According to the embodiments described in the fifth aspect and the sixth aspect of the present application, by providing the ventilation holes on the bottom surface of the garbage can, outside dust can be prevented from entering the garbage can as much as possible and smooth ventilation can be achieved.

According to a seventh aspect of the present application, a connecting device is provided, including:

an end mechanism;

an accommodating box disposed under the end mechanism;

a connecting mechanism located between the end mechanism and the accommodating box;

wherein the connecting mechanism is provided with at least two baffle plates, and the baffle plates form a wiring slot.

According to the embodiment described in the seventh aspect of the present application, the connecting device can be provided with the baffle plates to form the wiring slot, so that the internal circuits of the garbage can is well organized. Further, by providing a holding cavity on the connecting device, a space inside the garbage can could be saved.

According to an eighth aspect of the present application, a snap device is provided, including:

an end mechanism;

an accommodating box located under the end mechanism; and a connecting mechanism disposed between the end mechanism and the accommodating box;

wherein the connecting mechanism is provided with a spring structure to support the end mechanism when the end mechanism is turned up.

According to a ninth aspect of the present application, an intelligent garbage can is provided, including the snap device according to the eighth aspect of the present application.

According to the embodiments described in the eighth aspect and the ninth aspect of the present application, by providing the locking plate and the spring, when the end mechanism is turned up, it will stop when it opens to a certain degree of tension. This keeps the end mechanism from colliding with the accommodating box, thereby increasing the service life. Further, by providing the locking plate and the spring, the end mechanism can be supported to a certain extent when the end mechanism is turned up, sharing the bearing strength of the connecting part and prolonging the service life of the garbage can.

According to a tenth aspect of the present application, a holding device for mounting a conveyor belt is provided, including:

an end cap frame, an interior of the end cap frame being hollow, and a middle portion of the end cap frame being horizontally provided with a separation layer;

a first member, a middle of the first member being hollow, the first member being disposed above the separation layer; and a second member, a middle of the second member being hollow, the second member being disposed below the separation layer;

wherein the second member is provided with a mounting plate, an inner circle of the second member is provided with an inner circle flange, and the mounting plate and the inner circle flange form a mounting groove.

According to an eleventh aspect of the present application, an intelligent garbage can is provided, including the holding device according to the tenth aspect of the present application.

According to the embodiments described in the tenth aspect and the eleventh aspect of the present application, the mounting grooves can be provided as much as possible, so that the conveyor belt is supported everywhere and is less prone to shaking. The shaking phenomenon of the conveyor belt can be improved by arranging the mounting groove, which further improves the service life of the conveyor belt and reduces the cost.

According to a twelfth aspect of the present application, a positioning device is provided, including:

an end mechanism;

an accommodating box disposed under the end mechanism; and a connecting mechanism located between the end mechanism and the accommodating box;

wherein the accommodating box is provided with at least two positioning mechanisms, and the positioning mechanisms are disposed at intervals on a front surface of the connecting mechanism.

According to the embodiment described in the thirteenth aspect of the present application, a blind hole can be provided on the main body, and reinforcing ribs can be provided on the outer periphery, so that the positioning mechanism can be fully utilized, which is more conducive to assembly.

DETAILED DESCRIPTION

Figure 1:
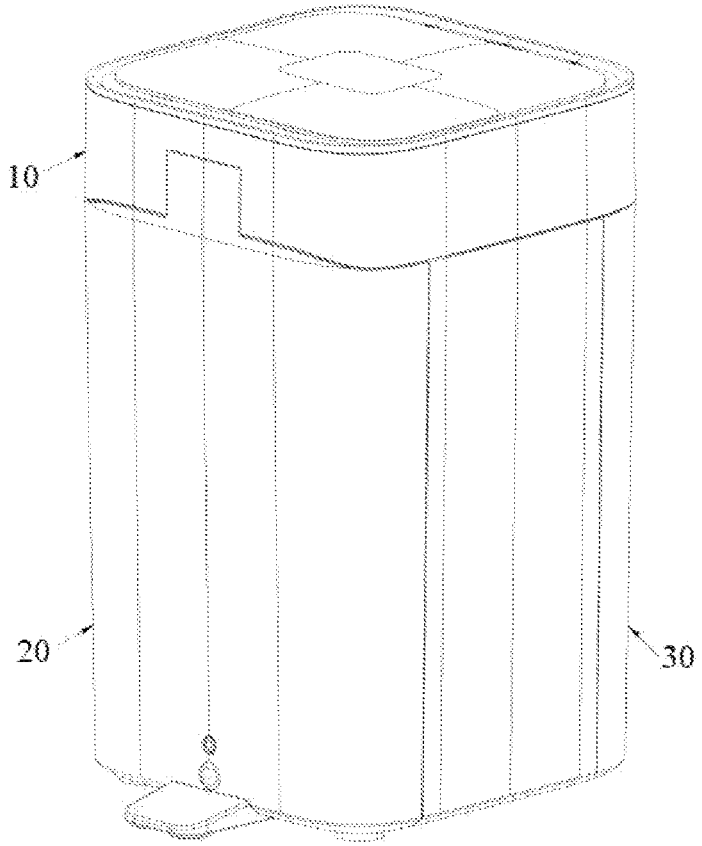
FIG. 1 is a perspective view of an intelligent garbage can proposed according to an embodiment of the present application.

The technical solutions in the embodiments of the present application will be clearly and completely described below with reference to the accompanying drawings in the embodiments of the present application. Obviously, the described embodiments are only a part of the embodiments of the present application, but not all of the embodiments. All other embodiments obtained by a person of ordinary skill in the art without creative work based on the embodiments in the present application fall within the protection scope of the present application.

In the drawings, the shapes and dimensions may be exaggerated for clarity, and the same reference numbers will be used throughout the drawings to refer to the same or like parts.

In the following description, terms such as center, thickness, height, length, front, back, rear, left, right, top, bottom, upper, lower, etc., are defined relative to the configurations shown in the various figures. In certain circumstances, "height" corresponds to a size from top to bottom, "width" corresponds to a size from left to right, and "depth" corresponds to a size from front to back. They are relative concepts, so they may change accordingly according to their different locations and different states of use. Therefore, these and other orientations should not be construed as limiting.

Terms relating to attachment, coupling, etc., (e.g., "connected" and "attached") refer to a relationship in which these structures are directly or indirectly fixed or attached to each other through intermediate structures, and refer to a movable or rigid attachment or relationship of these structures to each other through intermediate structures, unless expressly stated otherwise.

Figure 2:
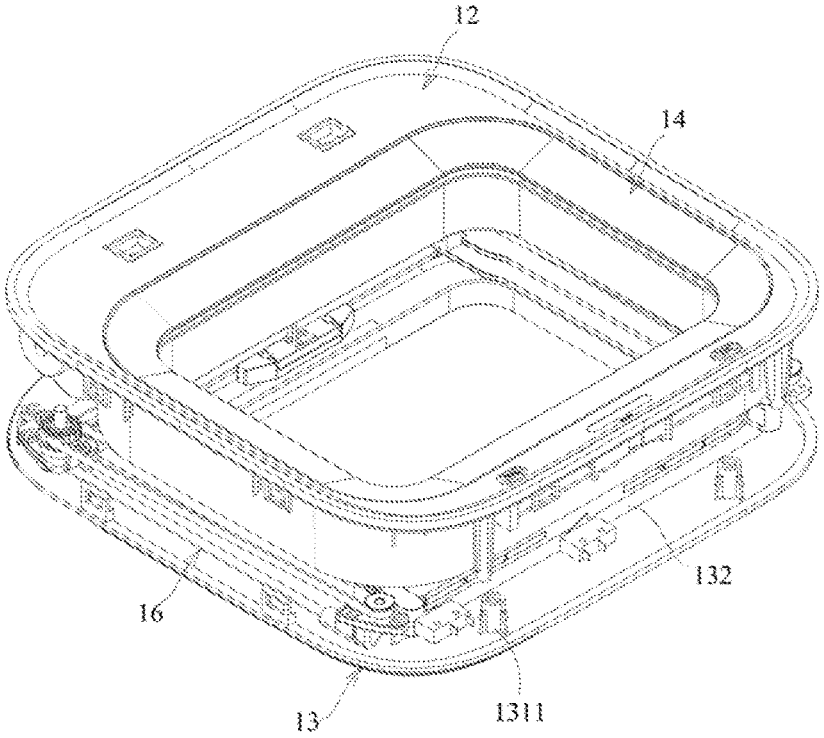
FIG. 2 is a perspective view of a partial end cap device proposed according to an embodiment of the present application.
Figure 3:
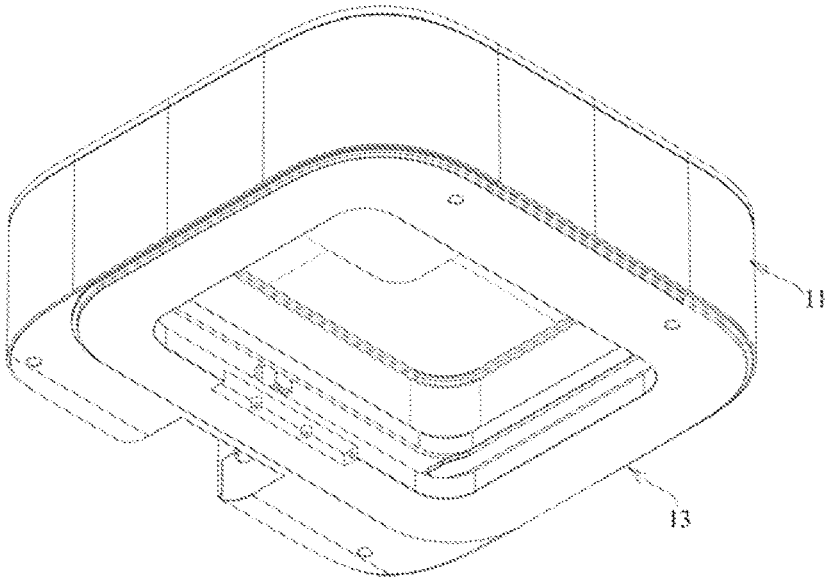
FIG. 3 is a perspective view of an end cap device proposed according to an embodiment of the present application.
Figure 8:
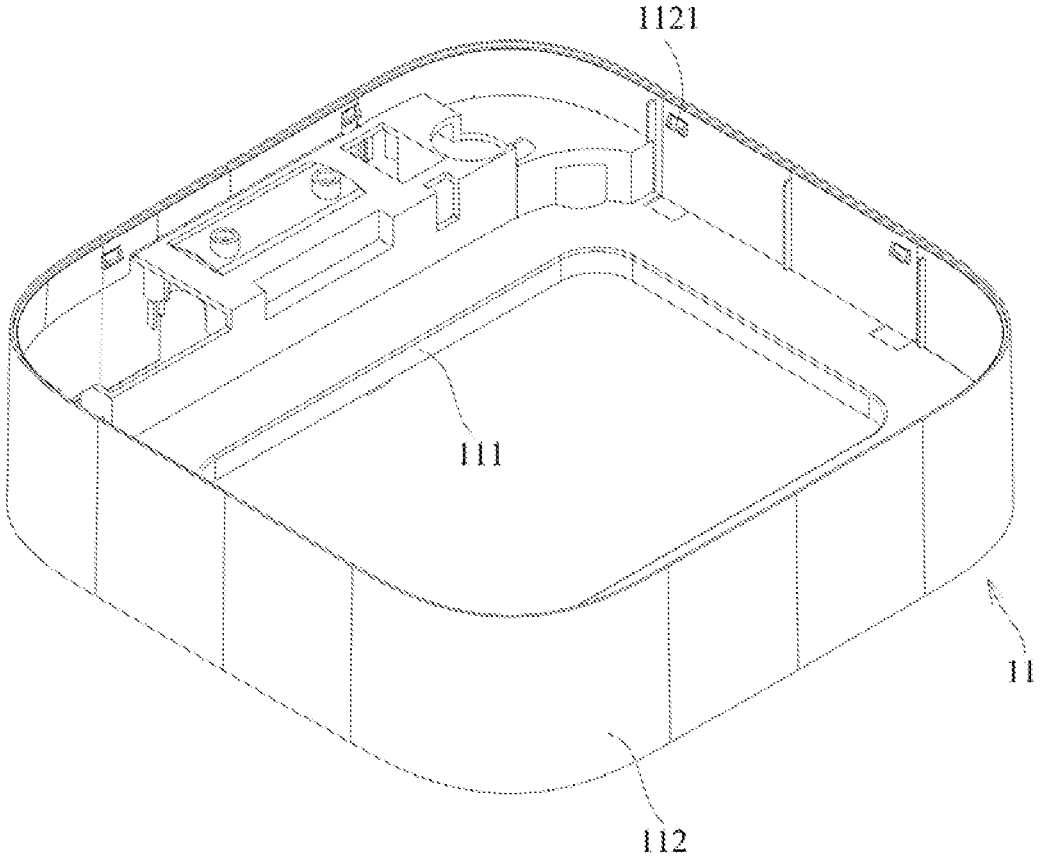
FIG. 8 is a perspective view of an end cap frame proposed according to an embodiment of the present application.

As shown in FIGS. 1 to 3, an embodiment of the present application provides an end cap device, and the device may include:

an end cap frame 11, an interior of the end cap frame 11 being hollow, and a middle portion of the end cap frame 11 being horizontally provided with a bracket 111 (as shown in FIG. 8);

a first member 12, a middle of the first member 12 being hollow, and the first member 12 being disposed above the bracket 111; and a second member 13, a middle of the second member 13 being hollow, and the second member 13 being disposed below the bracket 111;

the end cap frame 11, the first member 12 and the second member 13 are disposed coaxially from top to bottom in sequence, and the end cap device 10 is disposed above an equipment box 20 and an accommodating box 30.

The bracket 111 provides a guarantee for the stability of the first member 12 and the second member 13 in the end cap frame 11, and has a certain support for the first member 12, thereby reducing the supporting effect of the second member 13 on the first member 12.

Figure 4:
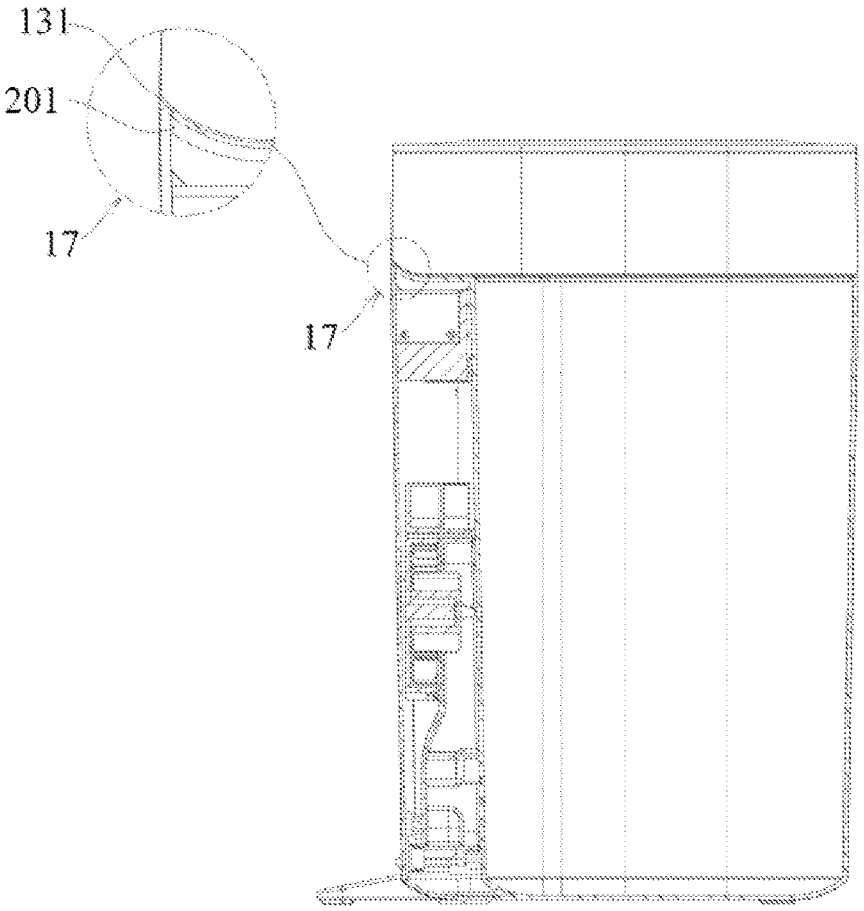
FIG. 4 is a partial cross-sectional view of an intelligent garbage can proposed according to an embodiment of the present application.

With reference to FIG. 4, it can be clearly seen that one side of the second member 13 is provided with an arc-shaped connecting portion 131 extending radially and outwardly. The arc-shaped connecting portion 131 is bent upwardly to form an arc-shaped surface. The arc-shaped surface is consistent with an equipment box end surface 201 of the equipment box 20 to ensure that the end cap device 10 and the equipment box are always in close contact when the garbage can is used, thereby ensuring airtightness and reducing the emission of peculiar smell.

Figure 5:
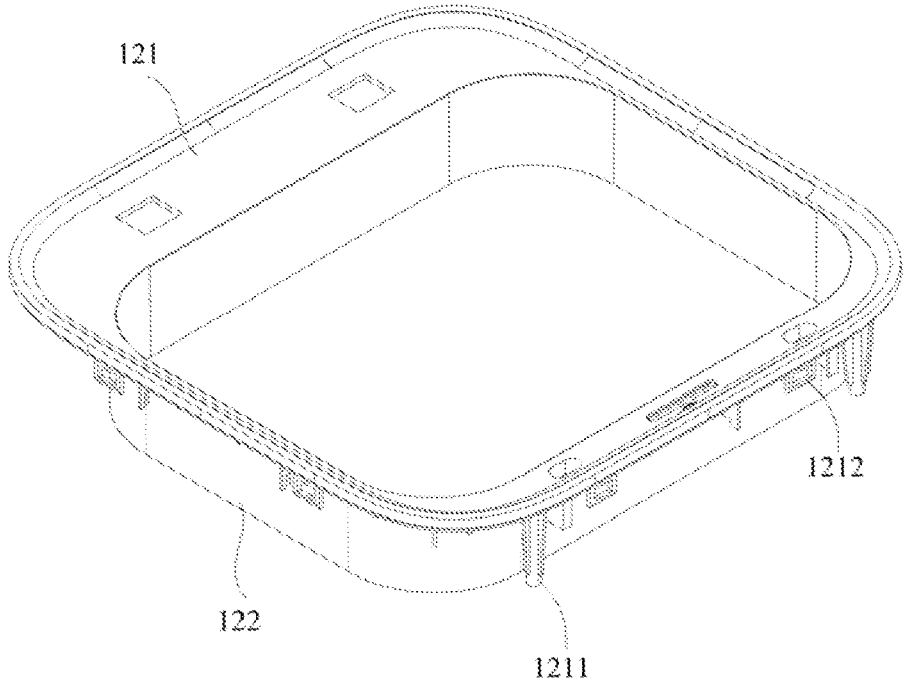
FIG. 5 is a perspective view of a first member proposed according to an embodiment of the present application.

Referring first to FIG. 5, it is described in detail that one side of the first member 12 is provided with a flange 121 extending radially and outwardly.

The flange 121 and the arc-shaped connecting portion 131 are disposed on a same side.

The first member 12 is provided with a skirt 122 extending axially and downwardly.

The first member 12 is provided with first support feet 1211 extending downwardly in an axial direction.

The supporting feet 1211 are distributed around the skirt 122 in a circular array and are integrated with the first member 12.

The first member 12 is provided with first snaps 1212 at intervals, and the first snaps 1212 are distributed in a circular array.

In a specific structure, a hollow portion of the first member 12 is provided with a garbage bag box 14. The purpose of providing the skirt 122 is that the skirt 122 also enables sealing throughout the end cap device 1 when the garbage bag box 14 leaves the first member 12. No dust or water will get inside the end cap, thus protecting the internal circuits.

Figure 6:
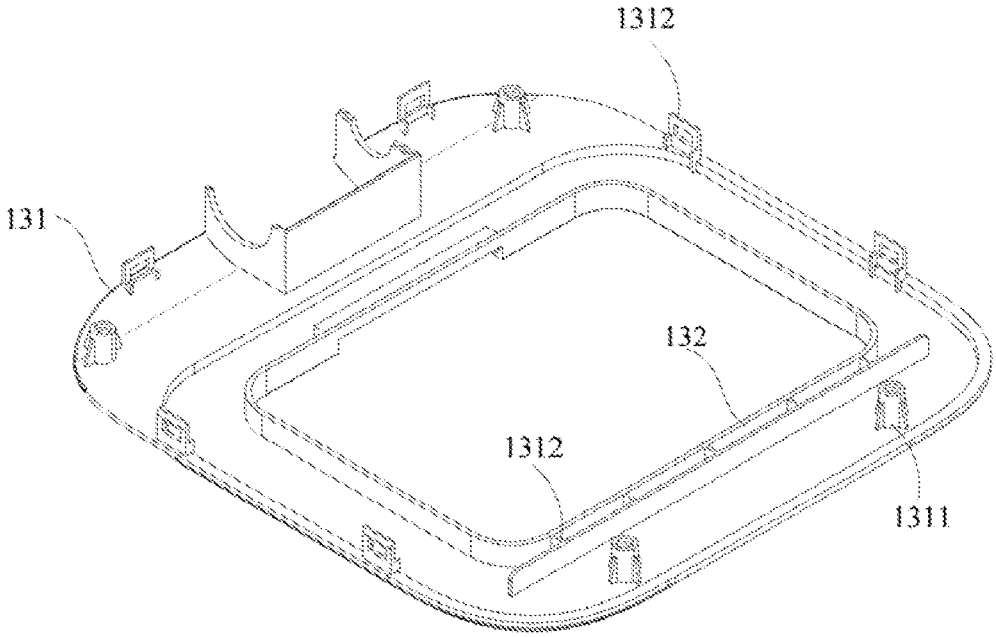
FIG. 6 is a perspective view of a second member proposed according to an embodiment of the present application.
Figure 7:
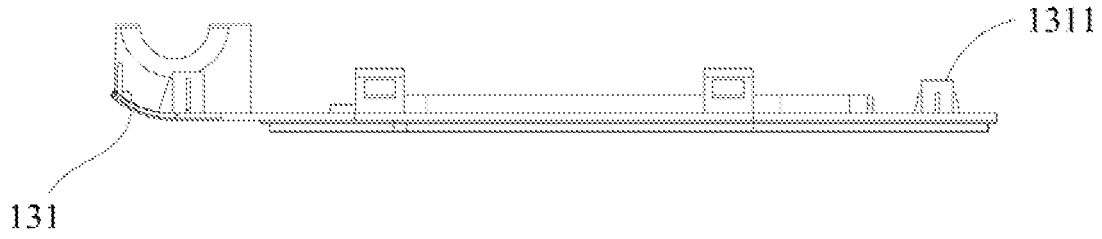
FIG. 7 is a front view of the second member according to the embodiment of the present application.

Referring now to FIG. 6, in conjunction with FIG. 7, it can be clearly seen that the second member 13 is provided with second support feet 1311 disposed at intervals, distributed in a circular array and extending upwardly in the axial direction.

The second member 13 is provided with second snaps 1312 at intervals, and the second snaps 1312 are distributed in a circular array.

The second member 13 is provided with a mounting groove 132 and partitions 1321 disposed in the mounting groove 132 at intervals.

In a specific embodiment, a packaging mechanism 16 is installed on the mounting groove 132. The partitions 1321 play a certain supporting role for the packing mechanism 16.

As shown in FIG. 8, it can be clearly seen that the end cap frame 11 is provided with a side wall 112. The side wall 112 is provided with hook structures 1121. A cross-sectional area of the hook structure 1121 gradually decreases inwardly along a radial direction.

The hook structures 1121 are respectively matched with the first snap 1212 and the second snap 1312 to form a snap structure.

Figure 9:
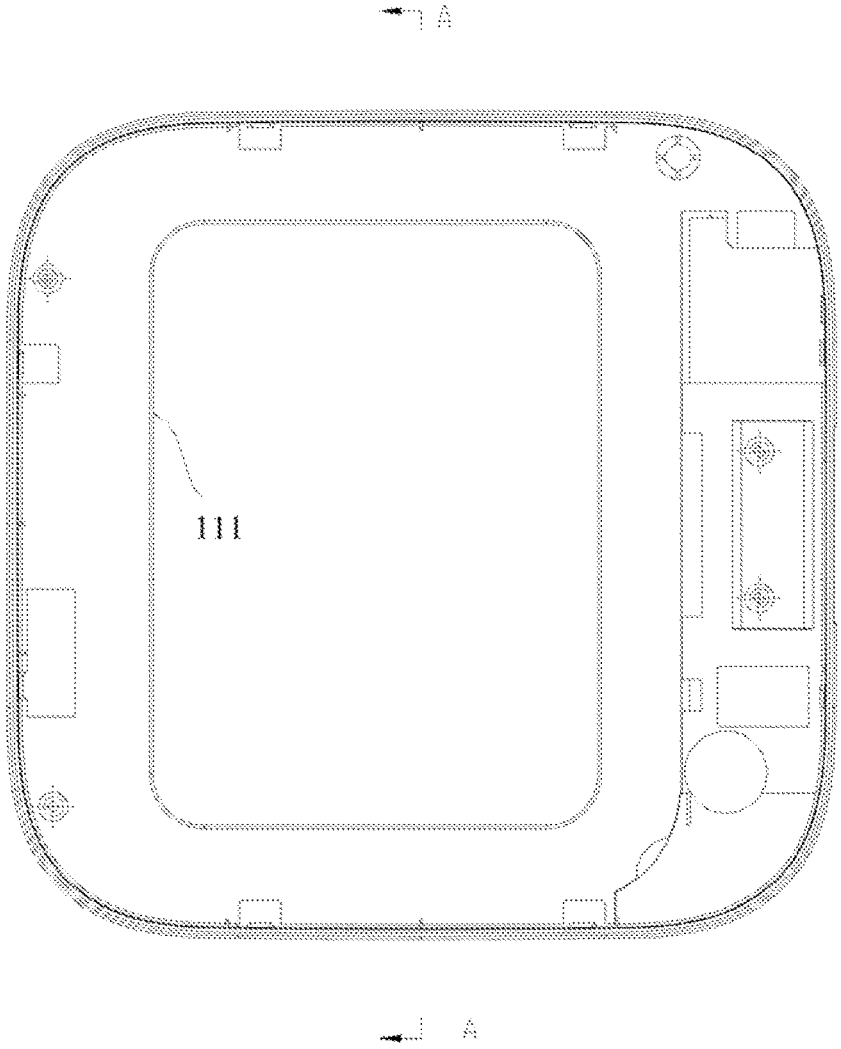
FIG. 9 is a top view of the end cap frame proposed according to the embodiment of the present application.
Figure 10:
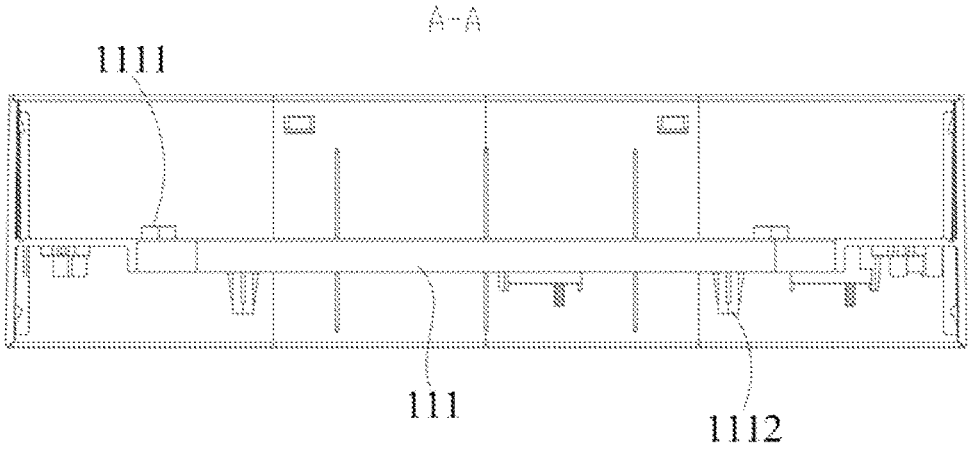
FIG. 10 is a cross-sectional view taken along line A-A of the end cap frame proposed according to the embodiment of the present application.

Referring now to FIG. 9, in conjunction with FIG. 10, it can be clearly seen that an upper end surface of the bracket 111 of the end cap frame 11 is provided with a partition support base 1111.

A lower end surface of the bracket 111 of the end cap frame 11 is provided with a partition support portion 1112.

Wherein the partition support base 1111 is matched with the first support foot 1211, and the partition support portion 1112 is matched with the second support base 1311.

The snap structure and the cooperation between the support feet and the support base are all to strengthen the stability between the various parts of the end cap device 10.

The number of equipment and processing scale described here are intended to simplify the description of the present application. Applications, modifications and variations to the present application will be apparent to those skilled in the art.

Figure 11:
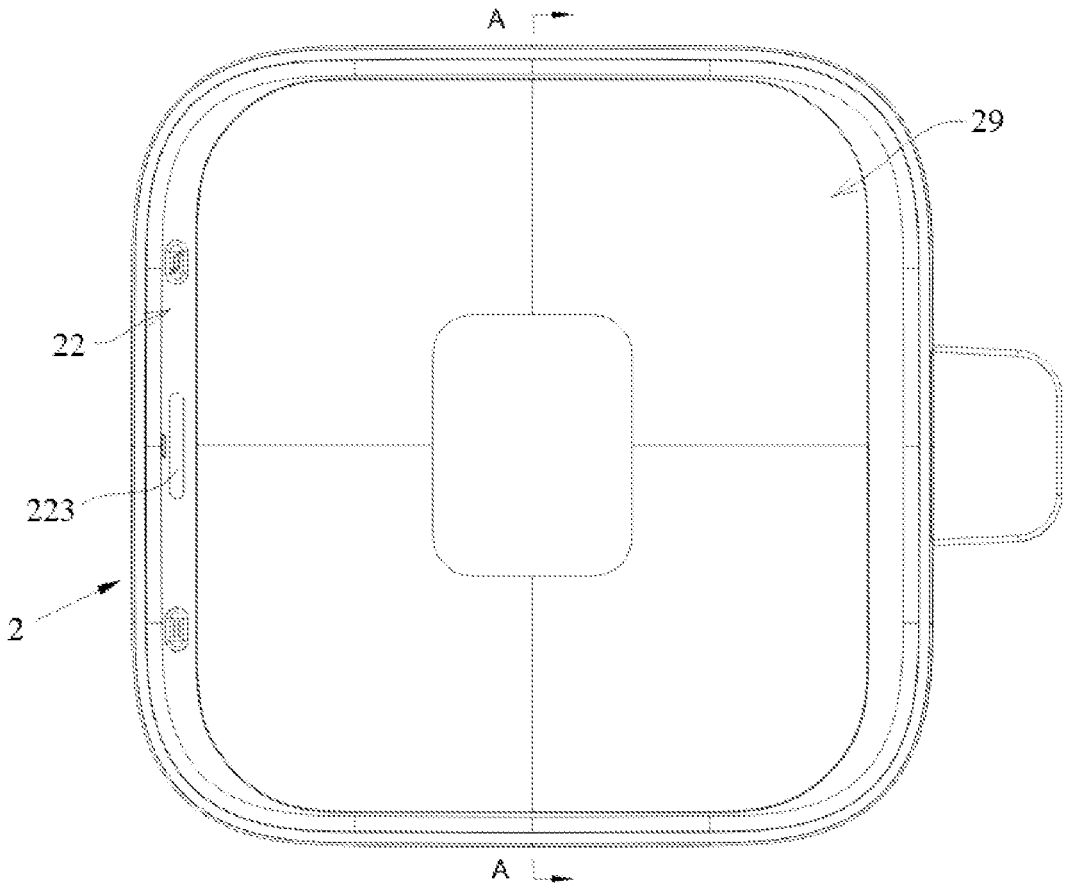
FIG. 11 is a top view of an intelligent garbage can proposed according to an embodiment of the present application.
Figure 12:
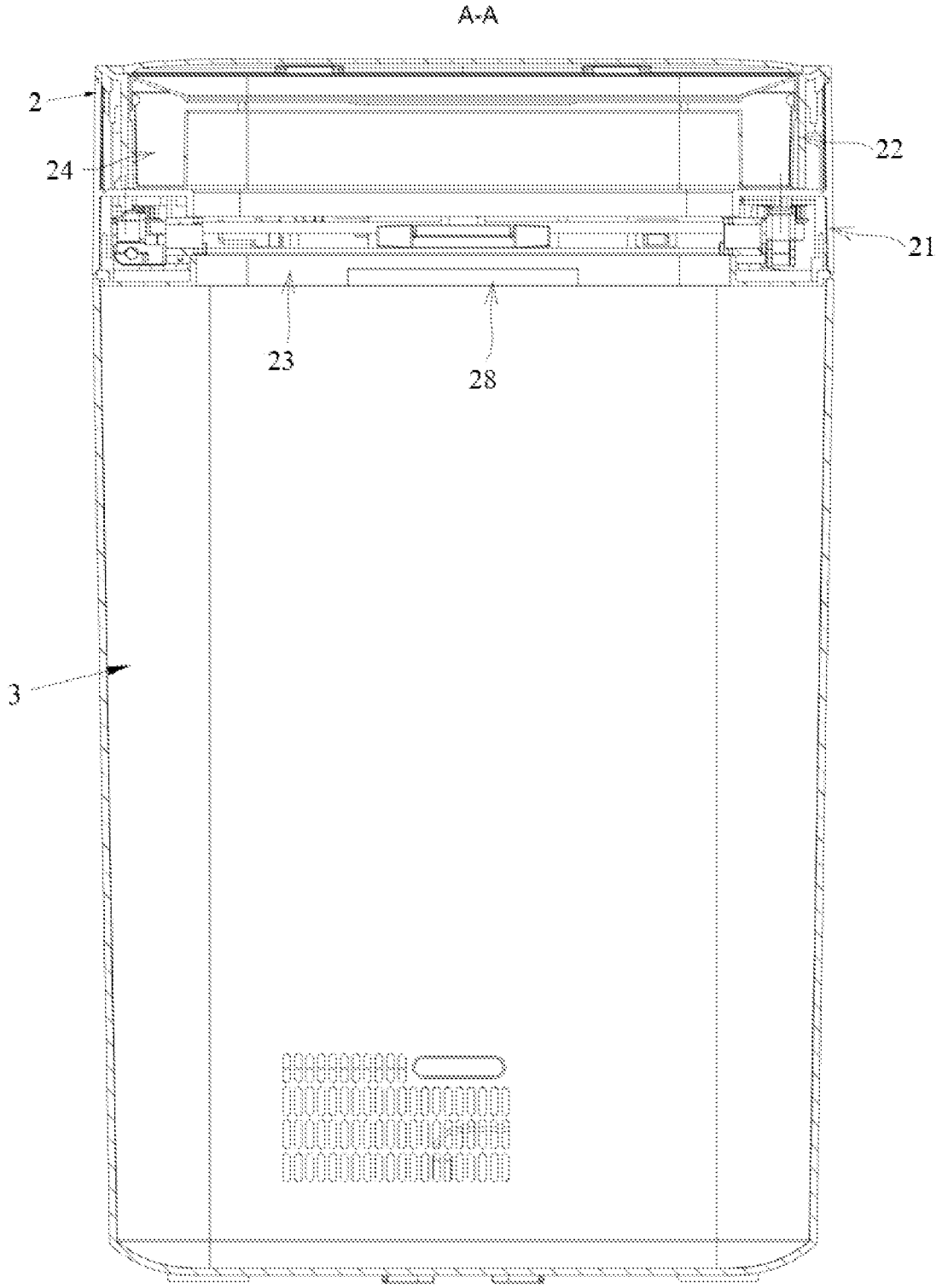
FIG. 12 is a cross-sectional view taken along line A-A of an intelligent garbage can proposed according to an embodiment of the present application.
Figure 13:
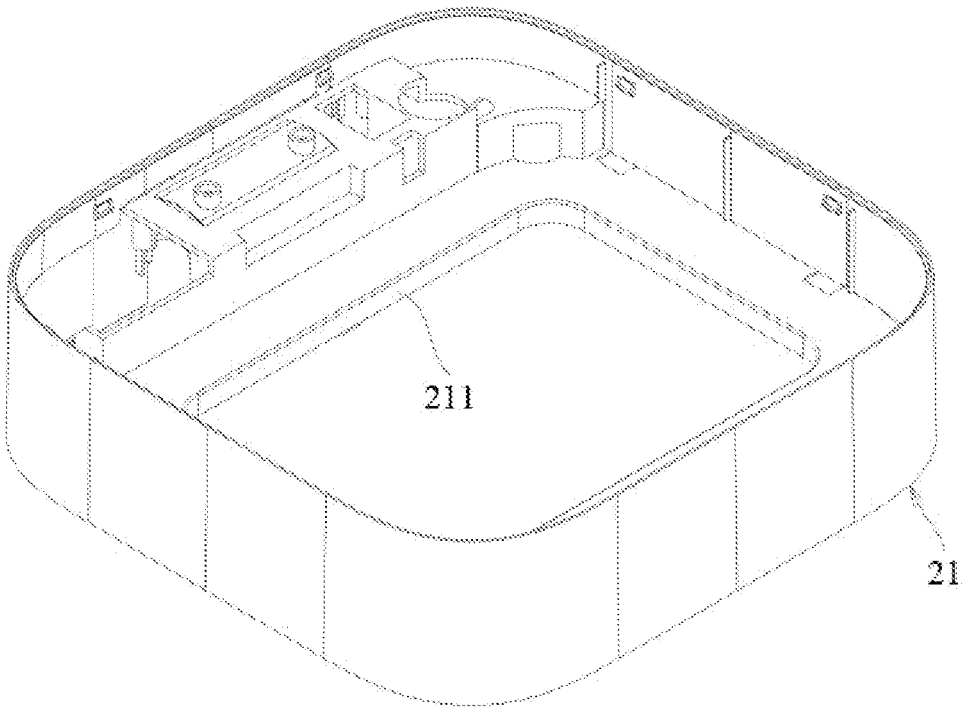
FIG. 13 is a perspective view of an end cap frame proposed according to an embodiment of the present application.

As shown in FIGS. 11 to 13, an embodiment of the present application provides an end cap device, and the device may include:

an end cap frame 21, an interior of the end cap frame 21 being hollow, and a middle portion of the end cap frame 21 being horizontally provided with a separation layer 211;

a first member 22, a middle of the first member 22 being hollow, and the first member 22 being disposed above the separation layer 211;

a second member 23, a middle of the second member 23 being hollow, and the second member 23 being disposed below the separation layer 211; and a lighting assembly 28, the lighting assembly 28 being disposed on a lower end face of the second member 23; wherein the lighting assembly 28 has a simple structure, does not occupy a space inside the garbage can, has low cost and high work efficiency.

Wherein the end cap frame 21, the first member 22 and the second member 23 are disposed coaxially from top to bottom in sequence.

Figure 14:
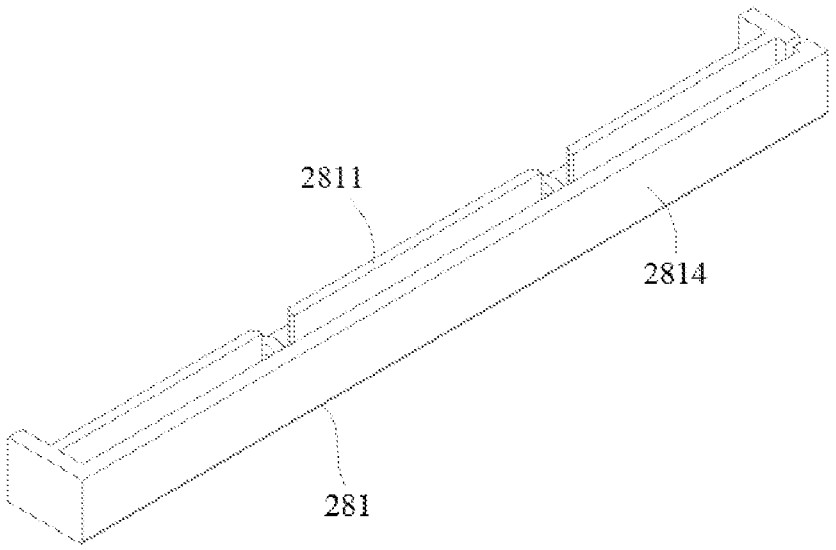
FIG. 14 is a perspective view of a lampshade according to an embodiment of the present application.
Figure 15:
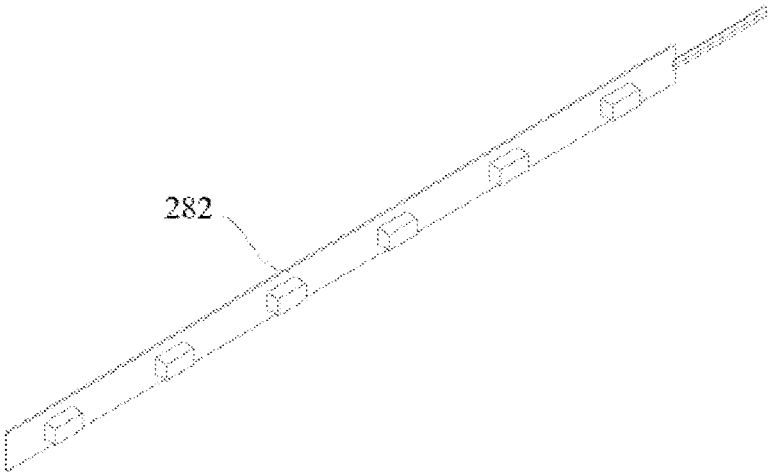
FIG. 15 is a perspective view of an LED lamp according to an embodiment of the present application.

Referring to FIGS. 14 and 15, it is shown in detail that the lighting assembly 28 may include:

a lampshade 281 provided with a flange 2814 on at least one side thereof; wherein it should be understood that the flange 2814 must be provided on an edge of the lampshade 281 facing the accommodating box 3 to ensure that lamps inside the lampshade 281 are not contaminated;

a LED lamp 282 provided inside the lampshade 281; and wherein a shape of the LED lamp 282 is adapted to the lampshade 281. The lampshade 281 is preferably in an elongated shape, so the LED lamp adapted to it is also in an elongated shape.

Although the lampshade 281 is described as being elongated, it may be cylindrical or square, or the like.

A middle of the lampshade 281 is provided with a middle partition plate 2811. The middle partition plate 2811 prevents the LED lamp inside the lampshade 281 from changing its position due to the dumping or shaking of the garbage can, resulting in poor lighting effects.

Figure 16:
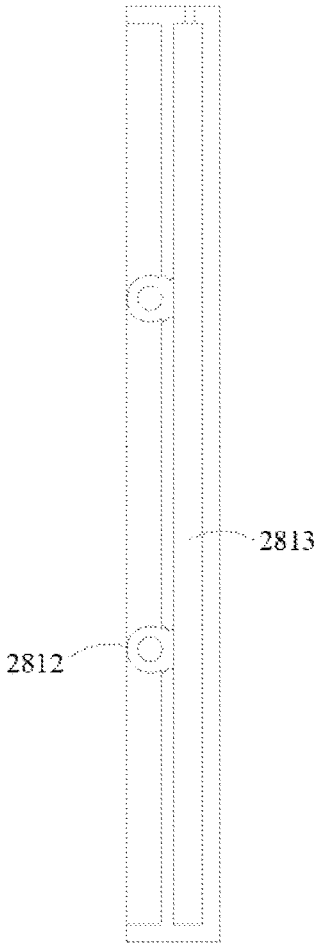
FIG. 16 is a top view of a lampshade according to an embodiment of the present application.

As shown in FIG. 16, it can be clearly seen that the middle partition plate 2811 and the flange 2814 form a receiving groove 2813.

At least two through holes 2812 are provided at a bottom of the lampshade 281.

Figure 17:
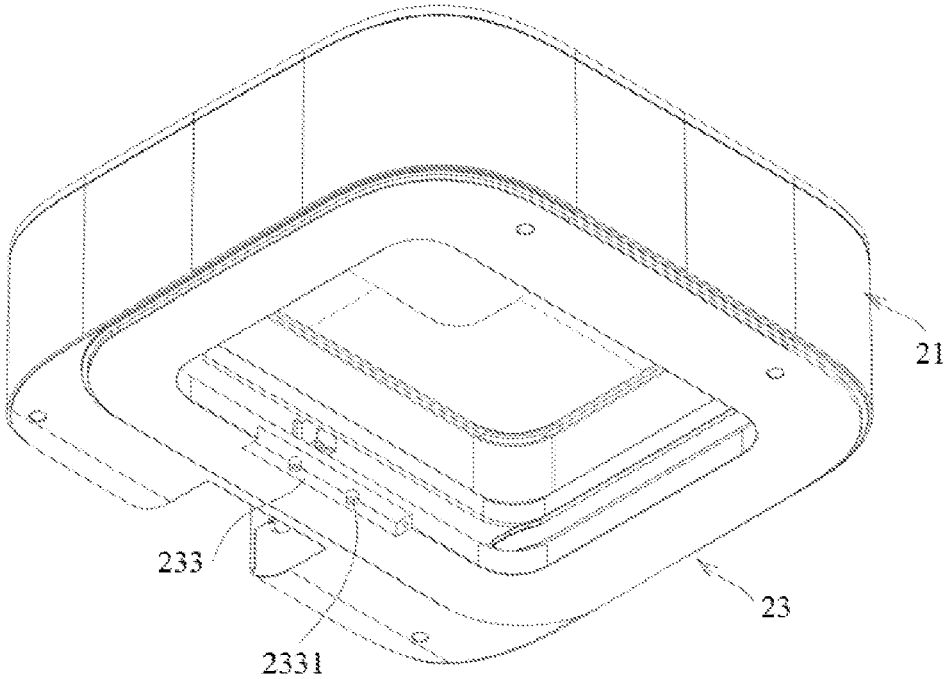
FIG. 17 is a perspective view of a part of an intelligent garbage can proposed according to an embodiment of the present application.

Referring now to FIG. 17, a lower end surface of the second member 23 is provided with a lampshade groove 233 recessed inwardly.

A mounting hole 2331 is provided at the top of the lampshade groove 233. The mounting hole 2331 is matched with the through hole 2812. The mounting hole 2331 and the through hole 2812 are fixed by a screw. This installation method is convenient for the staff to install and disassemble, and to replace the internal components.

In a specific embodiment, the LED lamp is placed in the receiving groove 2813. The material of the lampshade 281 is preferably a transparent plastic material, which can make the lighting efficiency of the LED lamp higher. In addition, the lampshade 281 can also play a certain protective role for the LED lamp.

Figure 18:
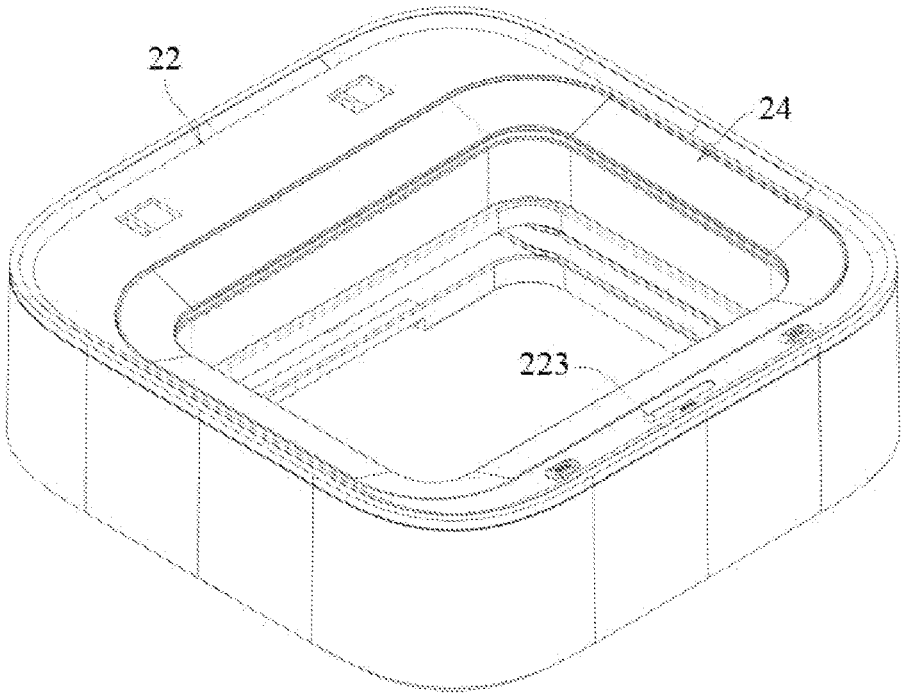
FIG. 18 is a perspective view of a part of an intelligent garbage can proposed according to an embodiment of the present application.

Referring now to FIG. 18, it can be seen that a sensing mechanism 223 is provided on the first member 22. The sensing mechanism 223 is disposed at the front of the upper end surface of the garbage can. When a person's hand or a shield covers the sensing mechanism 223, the cover plate 29 will be flipped upwardly, and the LED lamp will be illuminated by induction. The cover plate 29 will return to the initial state after a set time, and the LED lamp will be turned off at this time to avoid light pollution.

The purpose of the LED lamp is to illuminate the accommodating situation inside the accommodating box 3. Even in a dark environment, the garbage can be accurately put into the box, so that the internal storage situation can be seen at a glance, preventing the garbage from overflowing.

Referring again to FIG. 18, it can be clearly seen that the inner circle of the first member 22 is provided with a garbage bag box 24.

Figure 19:
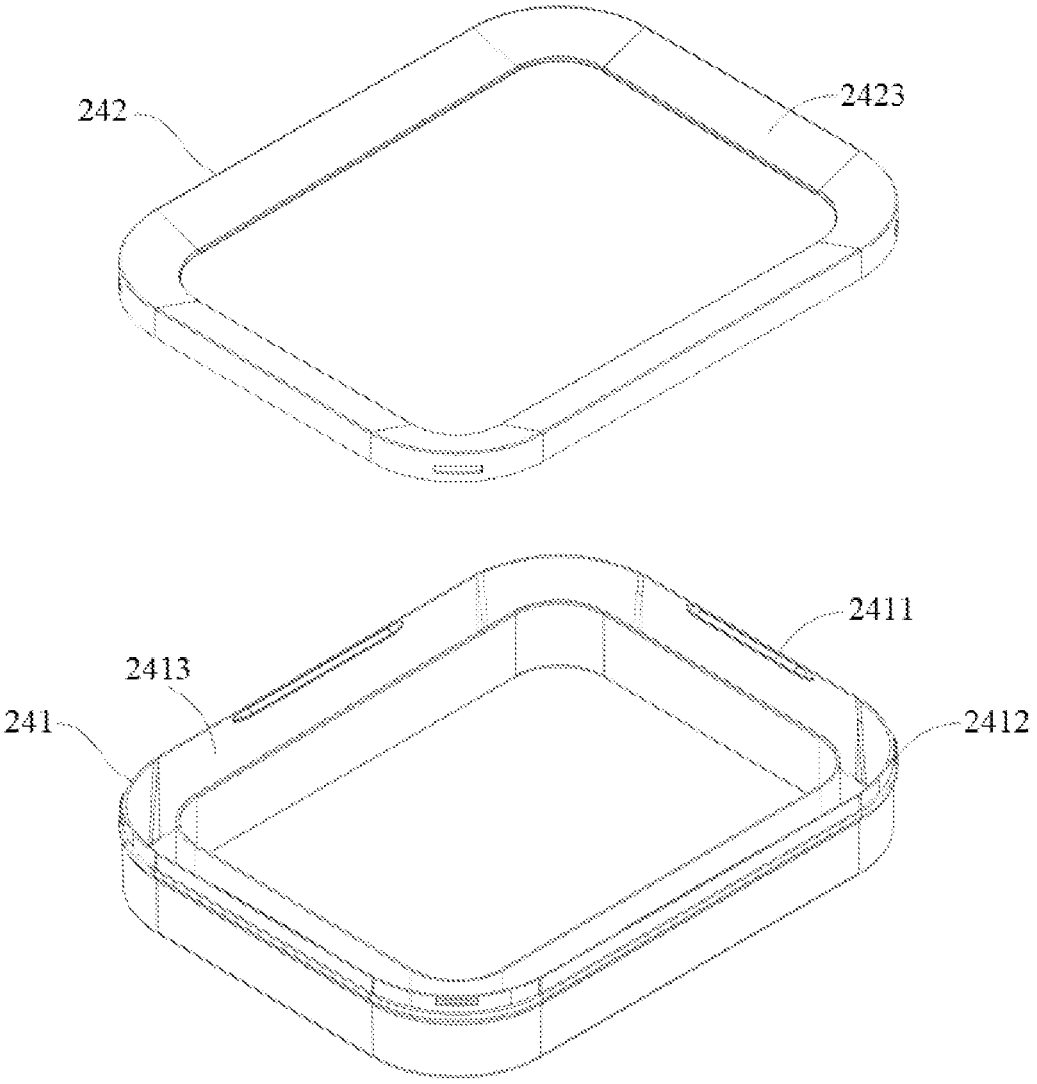
FIG. 19 is a perspective view of a device for separating a garbage bag box according to an embodiment of the present application.

Referring now to FIG. 19, in conjunction with the illustration of FIG. 18, the garbage bag box 24 is erected on the separation layer 211.

The garbage bag box 24 includes an upper cover 242 and a lower trough 241.

It should be understood that the lower trough 241 is surrounded by an outer circle side wall and an inner circle side wall.

Wherein the upper cover 242 is combined with the lower trough 241 to form a putting space.

A side wall of the upper cover 242 is provided with box snap holes 2422 at intervals.

Figure 20:
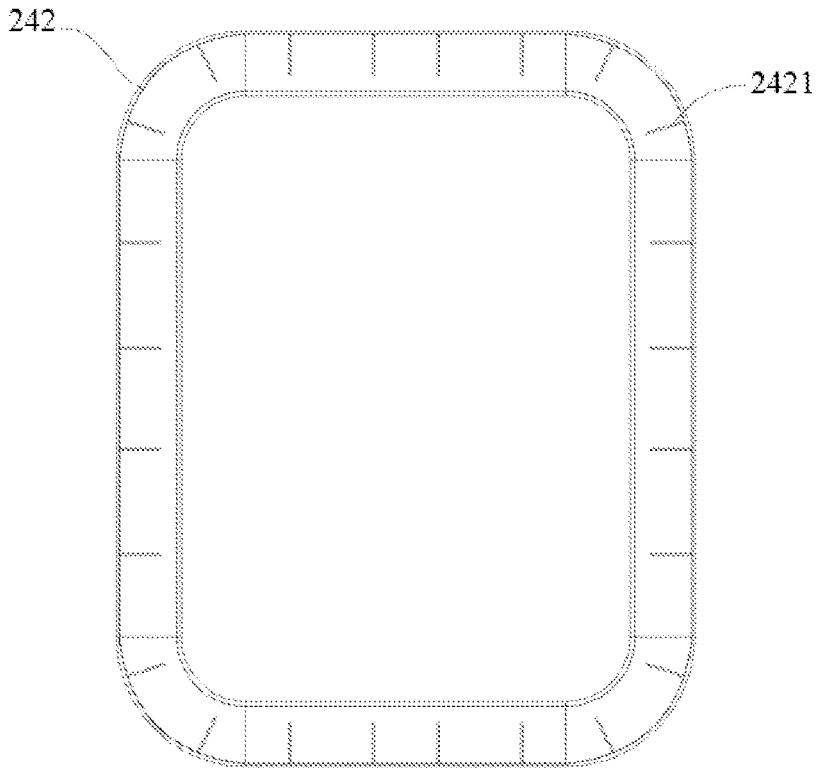
FIG. 20 is a bottom view of an upper cover according to an embodiment of the present application.
Figure 21:
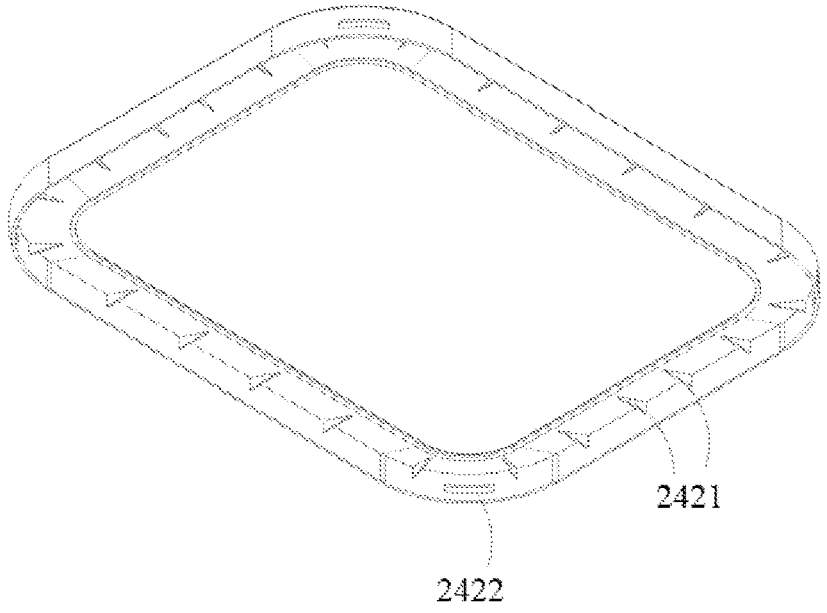
FIG. 21 is a perspective view of an upper cover according to an embodiment of the present application.

Referring now to FIG. 20 and FIG. 21, it can be clearly seen that the upper end surface of the upper cover 242 is provided with a flange 2423 extending downwardly in the radial direction, and the lower portion of the flange 2423 is provided with reinforcing ribs 2421 at intervals.

Box hooks 2412 are provided on an outer wall of the peripheral side wall of the lower trough 241. The box hooks 2412 are matched with the box snap holes 2422 to form a snap structure. The snap structure ensures that a garbage bag will not be scattered in the garbage bag box 24.

Protrusion 2411 are provided on an inner wall of the peripheral side wall of the lower trough 241. The protrusions 2411 are matched with the reinforcing ribs 2421, so that the upper cover 242 can be supported on the lower trough 241, thereby reducing the load-bearing strength of the snap structure.

The number of equipment and processing scale described here are intended to simplify the description of the present application. Applications, modifications and variations to the present application will be apparent to those skilled in the art.

Figure 22:
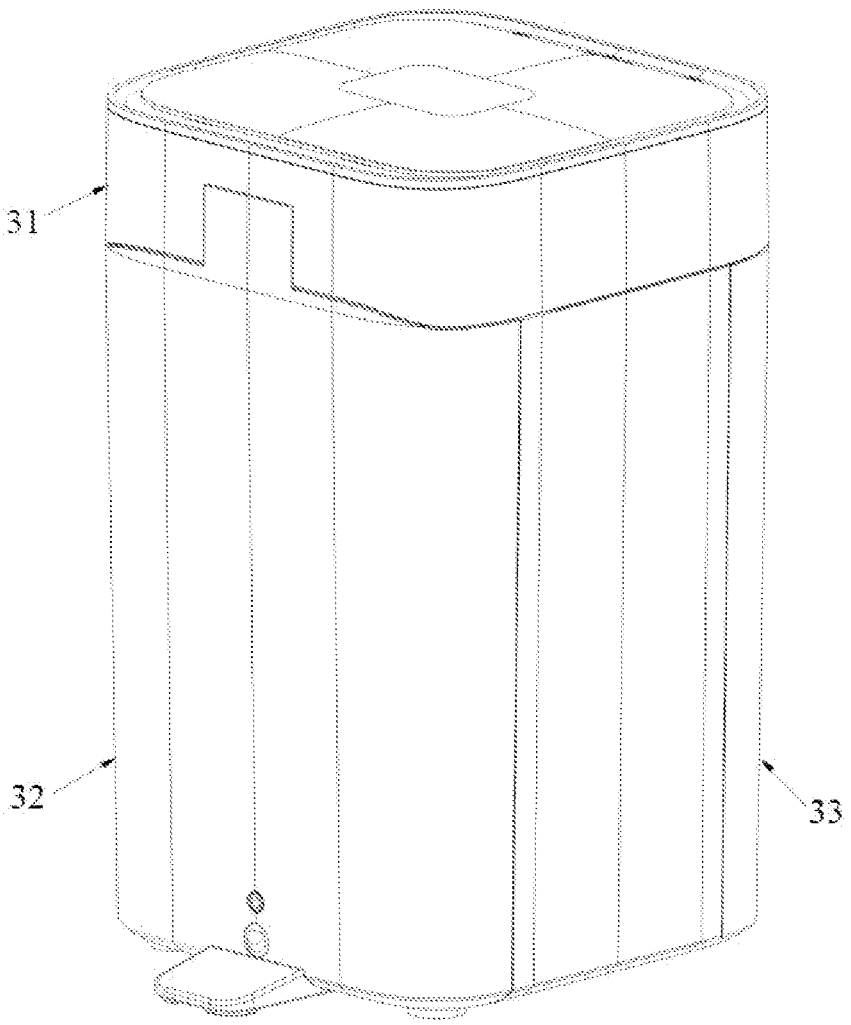
FIG. 22 is a perspective view of an intelligent garbage can proposed according to an embodiment of the present application.
Figure 23:
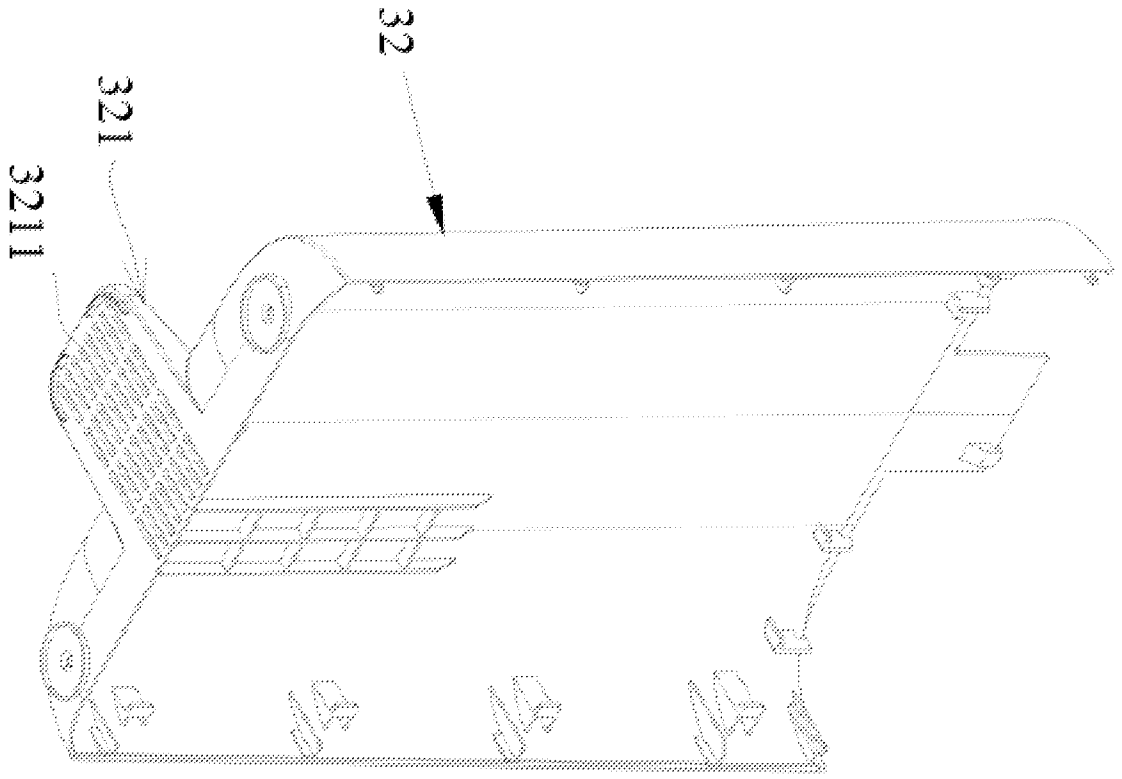
FIG. 23 is a perspective view of an outer casing proposed according to an embodiment of the present application.

As shown in FIG. 22 and FIG. 23, an embodiment of the present application provides a ventilation device, and the device may include:

an accommodating box 33; and an outer casing 32 disposed on one side of the accommodating box 33;

wherein the accommodating box 33 is fixedly connected to an equipment box 32, and a bottom surface of the outer casing 32 is provided with a plurality of mesh holes 3211 disposed in an array.

The outer casing 32 is provided with snap structures 321 disposed in a circular array at intervals.

Figure 24:
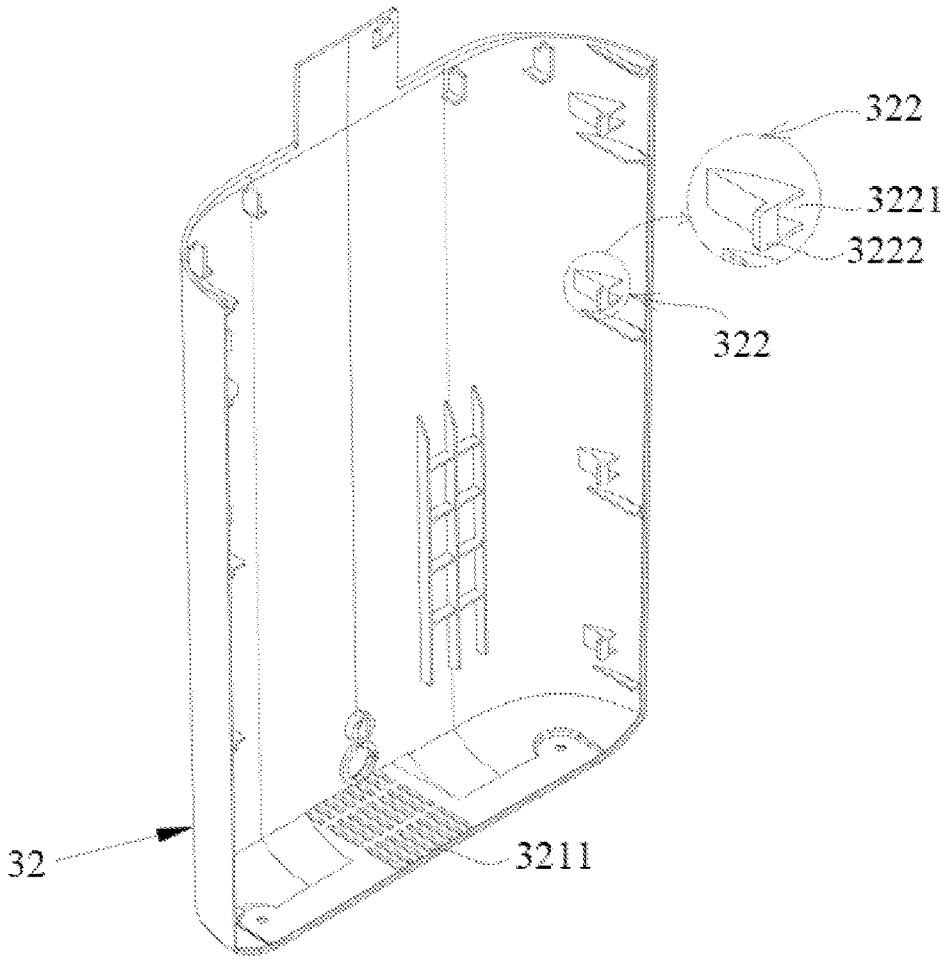
FIG. 24 is a perspective view of an outer casing proposed according to an embodiment of the present application.

Referring now to FIG. 24, it can be clearly understood that the snap structure 322 is recessed inwardly to form a groove 3221, and an edge of the groove 3221 is provided with an edge flange 3222.

A cross-sectional area of the snap structure 322 is gradually increasing along a direction in which the outer casing 32 approaches the accommodating box 33.

Figure 25:
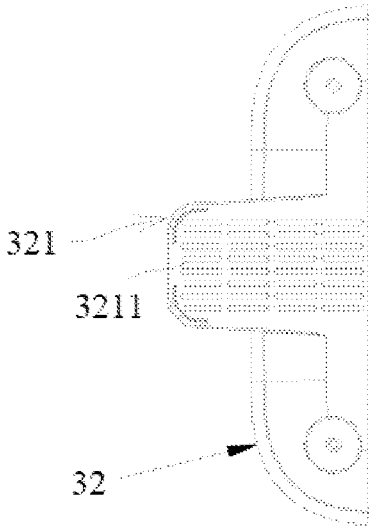
FIG. 25 is a bottom view of the outer casing proposed according to an embodiment of the present application.

Referring to FIG. 25, it can be noticed that a bottom end of the outer wall of the outer casing 32 is provided with a support portion 321.

The support portion 321 and the outer casing 32 are integrated, and a cross-sectional area of the support portion 32 gradually decreases outwardly from the outer casing 32.

An interior of the support portion 321 is hollow.

A bottom surface of the support portion 321 is provided with mesh holes 3211 disposed in an array, and the mesh holes 3211 are in connecting with the mesh holes 3211 on the bottom surface of the outer casing 32. The mesh holes 3211 for ventilation of the support portion 321 are set as a whole, which can make it difficult for dust to enter the inside of the garbage can under the condition of ensuring ventilation, so that the environment inside the garbage can becomes clean and tidy, and it is convenient for the user to maintain the cleanliness of the garbage can.

Although it is not shown in the drawings, it should be understood that the bottom of the garbage can is provided with protrusions that play a supporting role, on the one hand, it supports the garbage can; on the other hand, the mesh holes 3211 for ventilation at the bottom are exchanged with the ambient air. And even if dust is brought into the garbage can, it will be deposited under the garbage can due to gravity, or it will fall out of the garbage can, creating an automatic cleaning effect.

Figure 26:
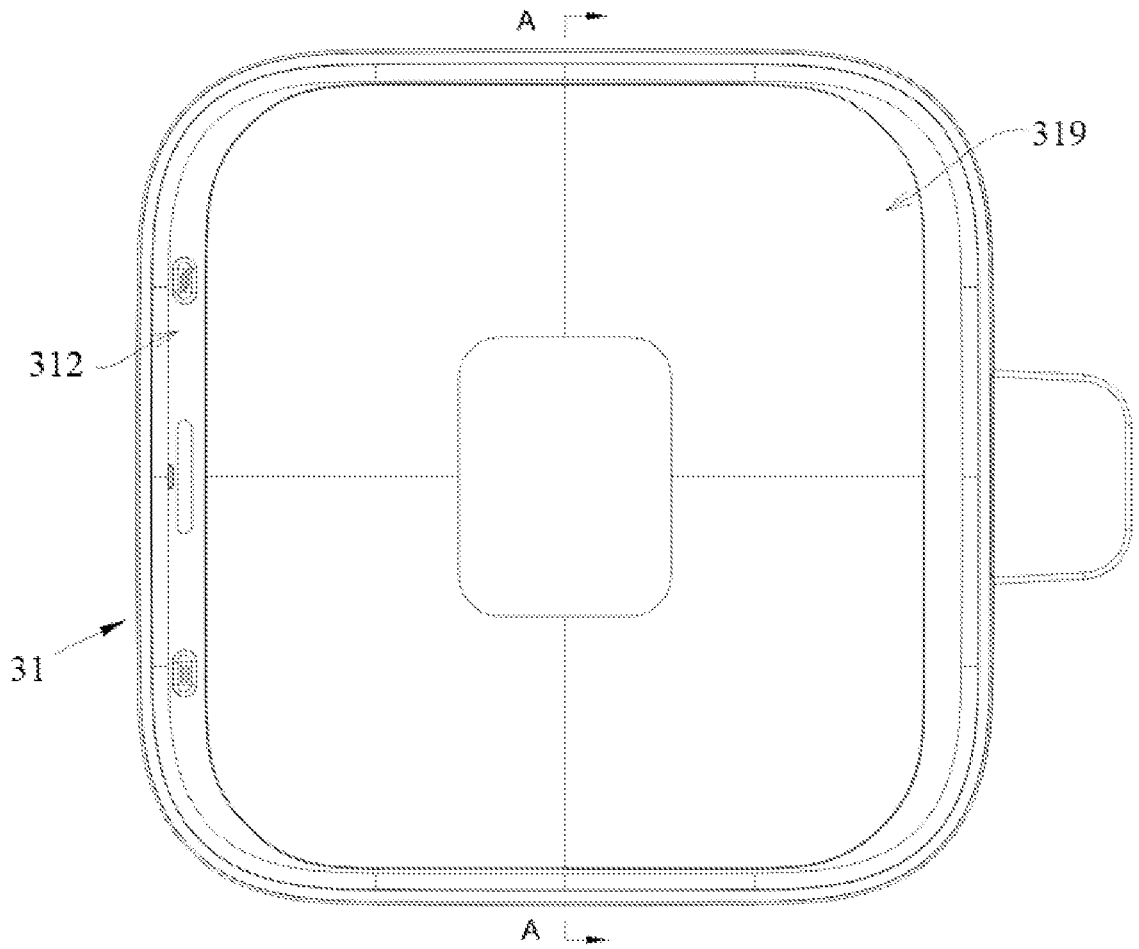
FIG. 26 is a top view of a garbage can proposed according to an embodiment of the present application.
Figure 27:
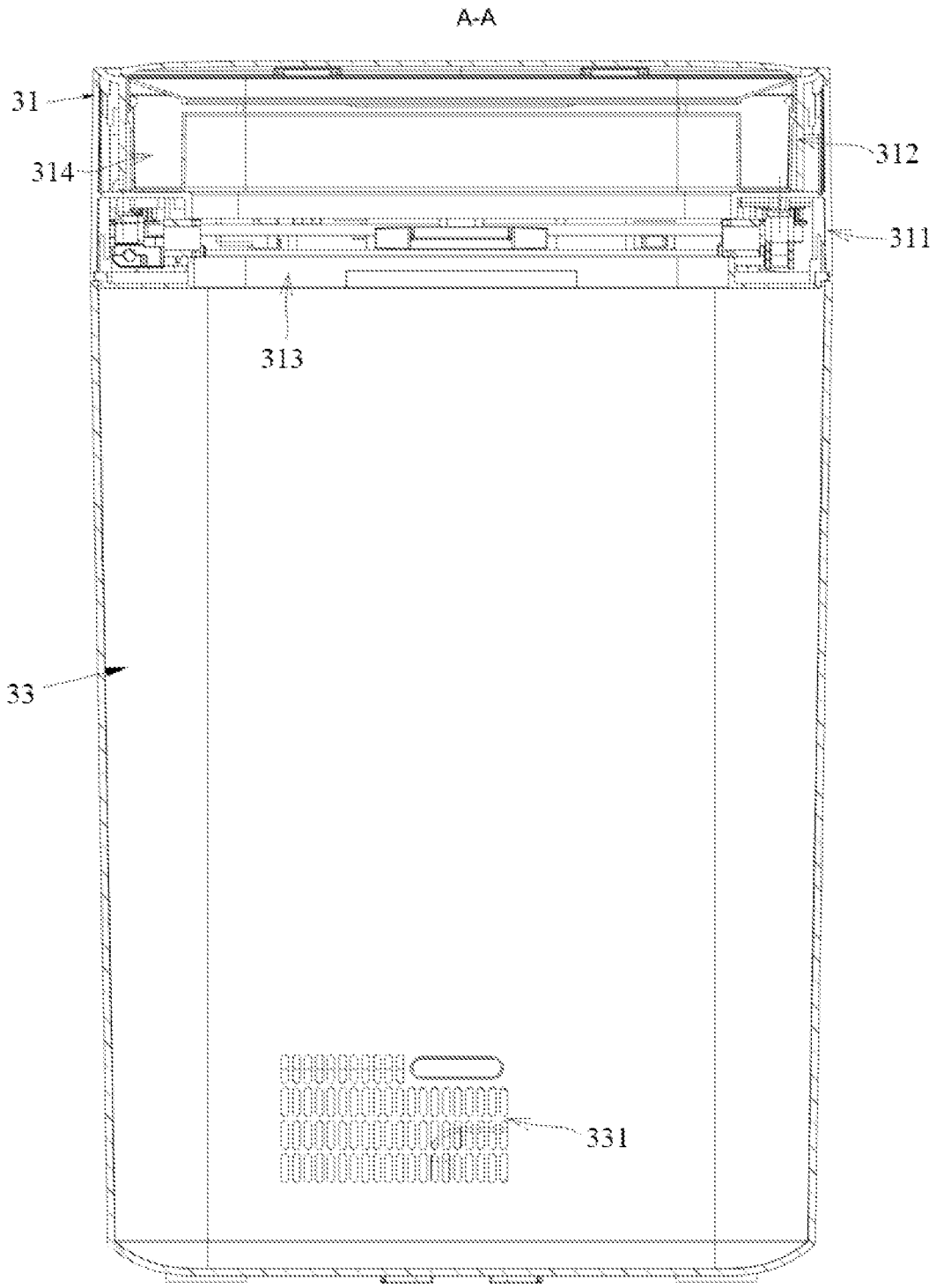
FIG. 27 is a cross-sectional view taken along line A-A of a garbage can proposed according to an embodiment of the present application.

Referring now to FIG. 26 and FIG. 27, it can be clearly seen that a lower portion of a surface of the accommodating box 33 in contact with the outer casing 32 is provided with ventilation holes 331 disposed in an array.

Figure 28:
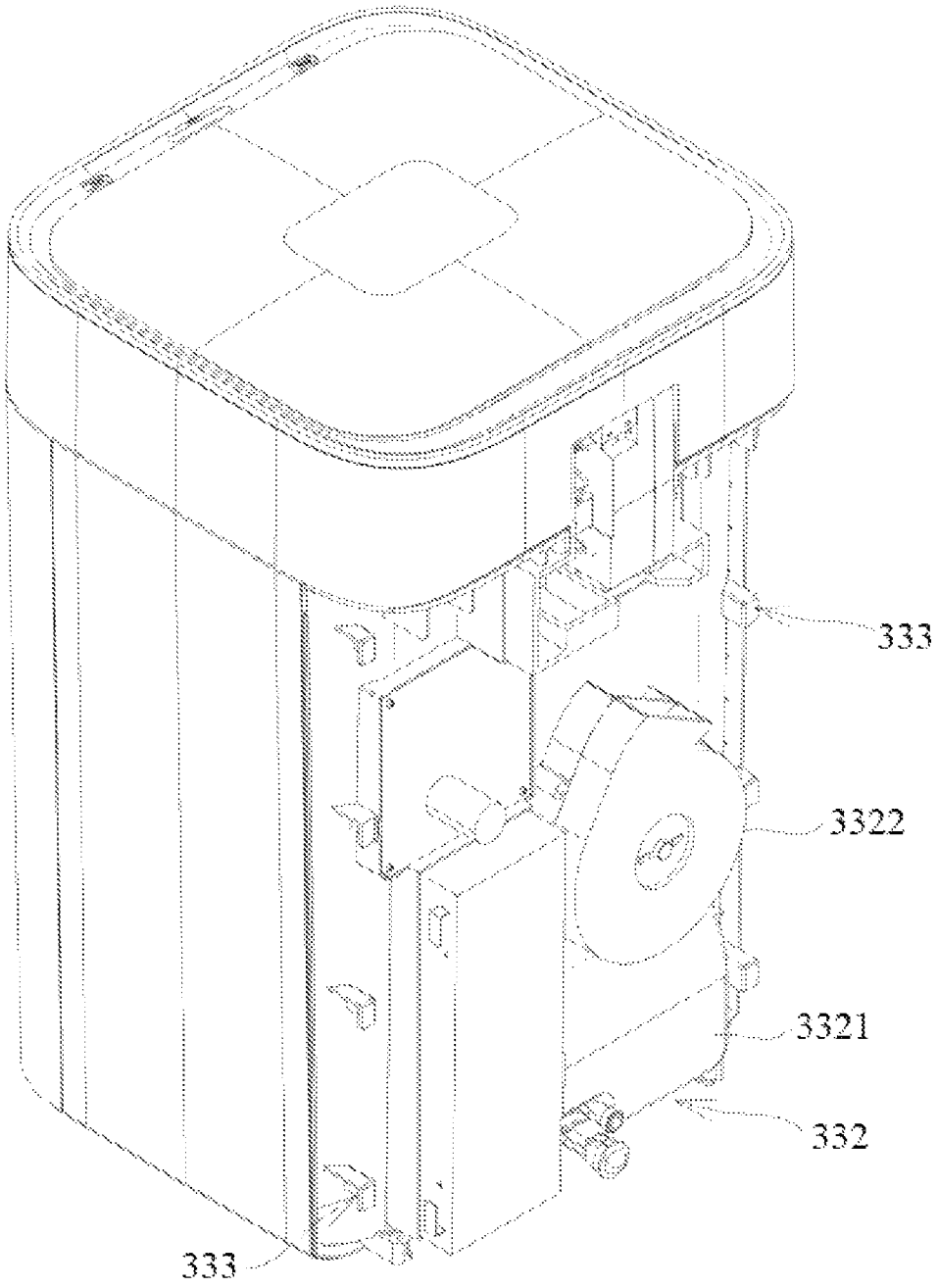
FIG. 28 is a perspective view of a part of a garbage can proposed according to an embodiment of the present application.
Figure 29:
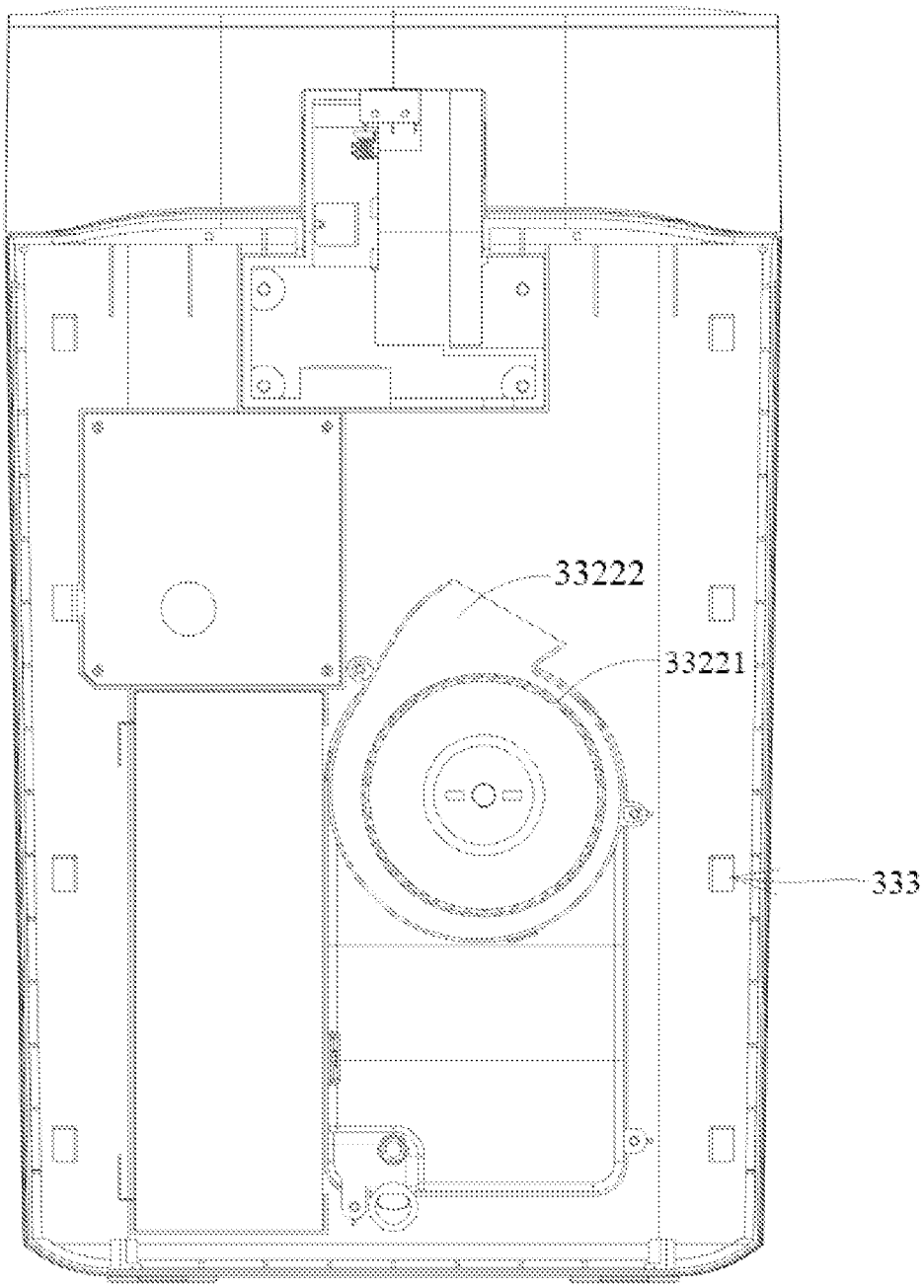
FIG. 29 is a rear view of a part of a garbage can proposed according to an embodiment of the present application.

As shown in FIG. 28 and FIG. 29, a gathering mechanism 332 is provided on the outer wall of the accommodating box 33, and the gathering mechanism 332 includes:

a bellows 3321 covering the ventilation holes 331; and a guide fan 3322 disposed above the bellows 3321.

The guide fan 3322 includes:

a guide impeller 33221 disposed coaxially with a casing of the guide fan 3322;

an air outlet channel 33222 being tangent to a main body of the guide fan 3322.

In a specific embodiment, when the guide impeller 33221 starts to be activated, the turbid air inside the accommodating box 33 will enter the bellows 3321 from the ventilation hole 331 in the lower portion due to the flow of air and converge. Then, the turbid air is discharged from the air outlet channel 33222 and enters the outer casing 32 along a rotation direction of the guide impeller 33221. After circulation, the turbid air is discharged out of the trash can through the mesh holes 3211 at the bottom.

The accommodating box 33 is provided with hook structures 333 at intervals.

Wherein the hook structures 333 and the accommodating box 33 are integrated. The clip structure 333 is matched with the snap structure.

The hook structure 333 is provided with three-sided flanges. The three-sided flanges form a resting space. The edge flange 3222 of the snap structure 322 is disposed in the resting space, so that the outer casing 32 and the accommodating box 33 can be closely matched.

The number of equipment and processing scale described here are intended to simplify the description of the present application. Applications, modifications and variations to the present application will be apparent to those skilled in the art.

Figure 30:
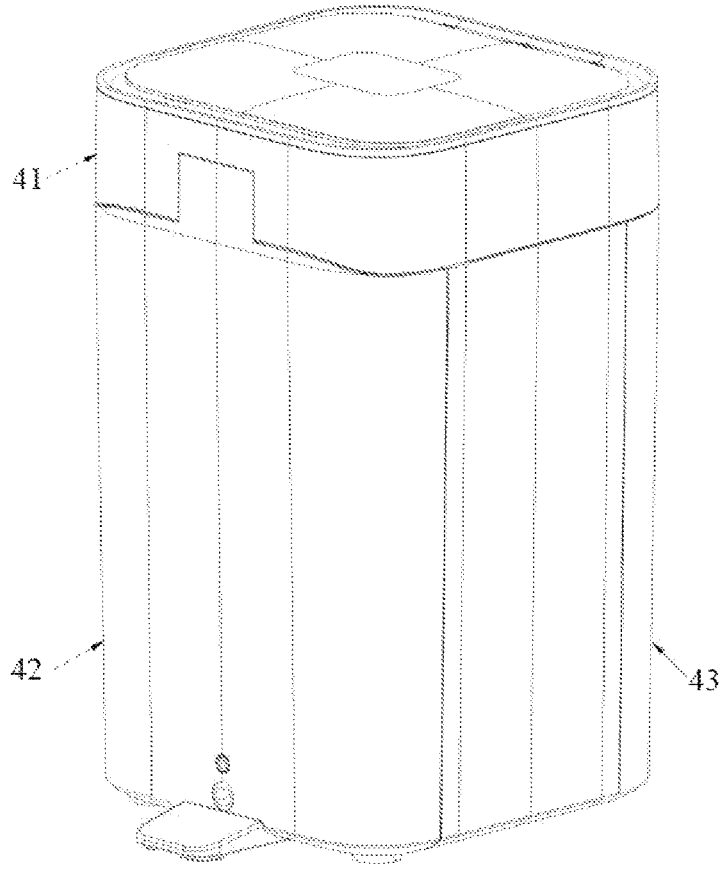
FIG. 30 is a perspective view of an intelligent garbage can proposed according to an embodiment of the present application.
Figure 31:
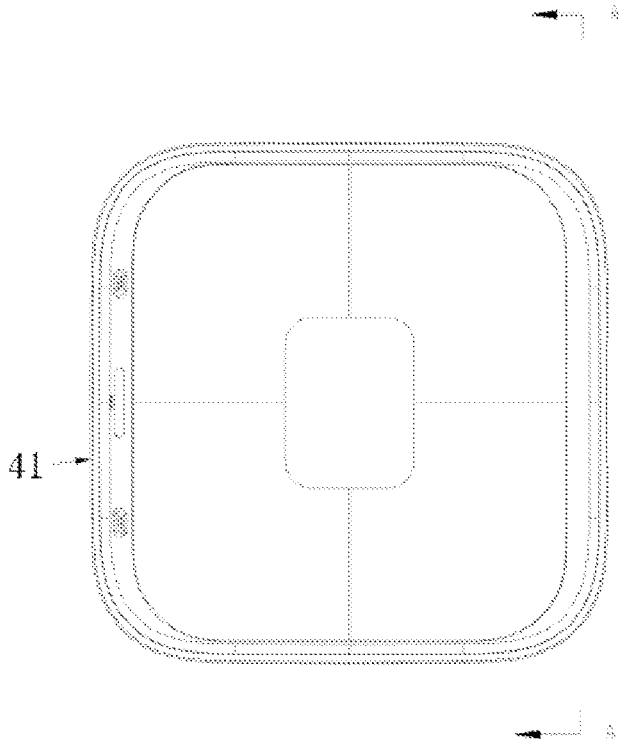
FIG. 31 is a top view of an intelligent garbage can proposed according to an embodiment of the present application.
Figure 32:
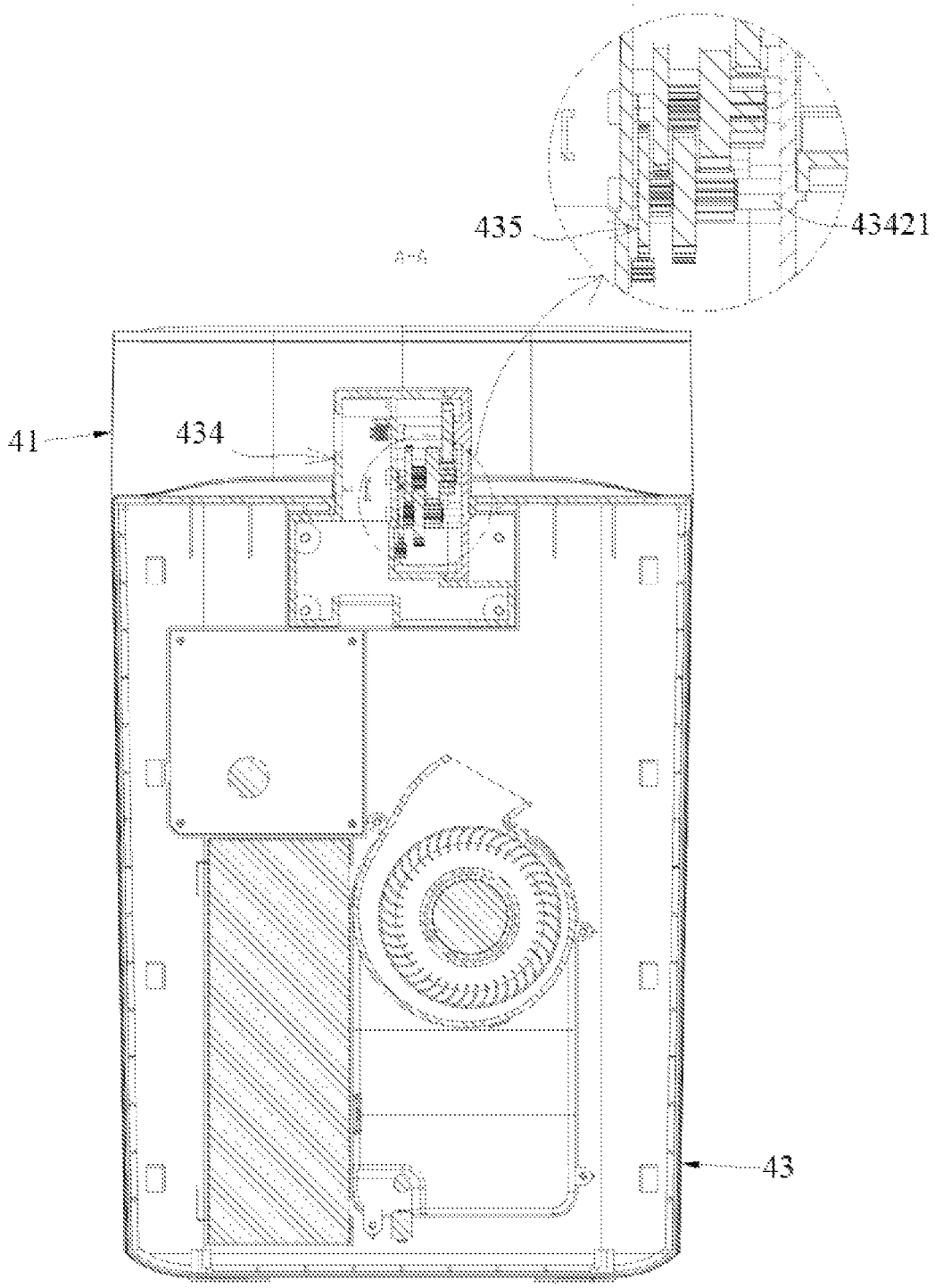
FIG. 32 is a partial cross-sectional view of an intelligent garbage can proposed according to an embodiment of the present application.

As shown in FIG. 30, FIG. 31 and FIG. 32, an embodiment of the present application provides a connecting device, and the device may include:

an end mechanism 41;

an accommodating box 43 disposed under the end mechanism 41; and a connecting mechanism 434 located between the end mechanism 41 and the accommodating box 43.

Figure 33:
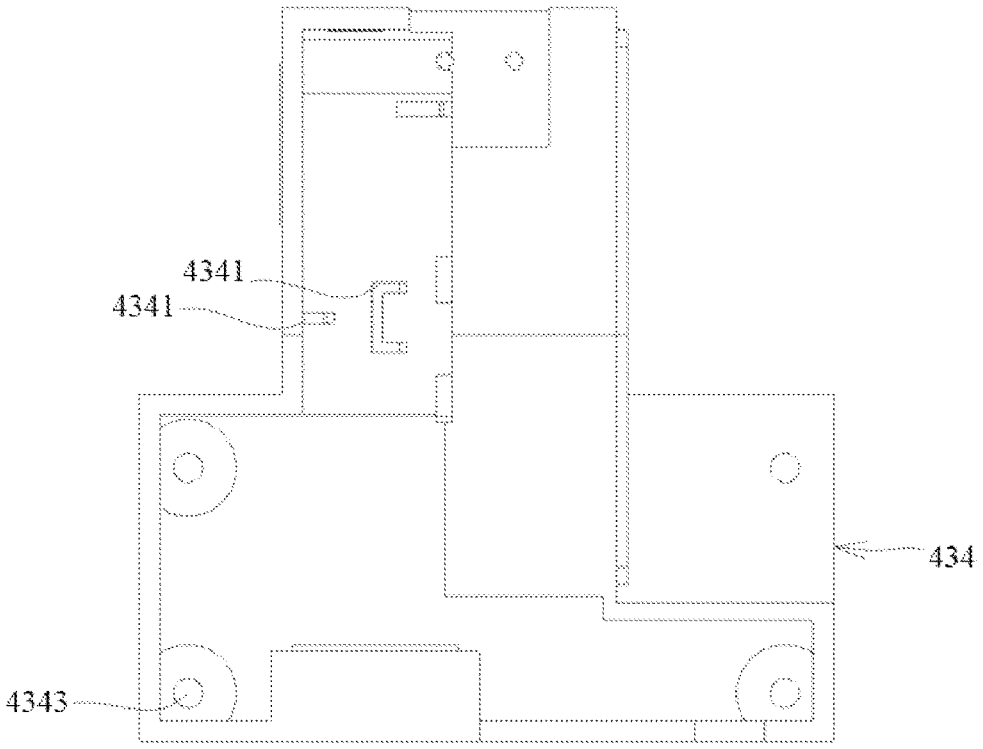
FIG. 33 is a perspective view of a connecting device according to an embodiment of the present application.

Referring now to FIG. 33, it can be clearly understood that the connecting mechanism 434 is provided with at least two baffle plates 4341, and the baffle plates 4341 form a wiring slot.

The baffle plate 4341 can also fix the internal structure, for example, a motor capable of driving the movement of the internal components of the intelligent garbage can. The motor is placed on the baffle plate 4341. On the one hand, the baffle plate 4341 can also play a certain supporting role for the motor; and on the other hand, the wiring slot formed by the baffle plates 4341 can also arrange the circuit wires connected to the motor in an orderly manner, so that the wiring inside the intelligent garbage can is not entangled and the occurrence of faults is reduced.

The connecting mechanism 434 has a convex shape as a whole.

An upper portion of the connecting mechanism 434 is rotatably connected with the end mechanism 434.

A lower portion of the connecting mechanism 434 is fixedly connected with the accommodating box 43.

Figure 34:
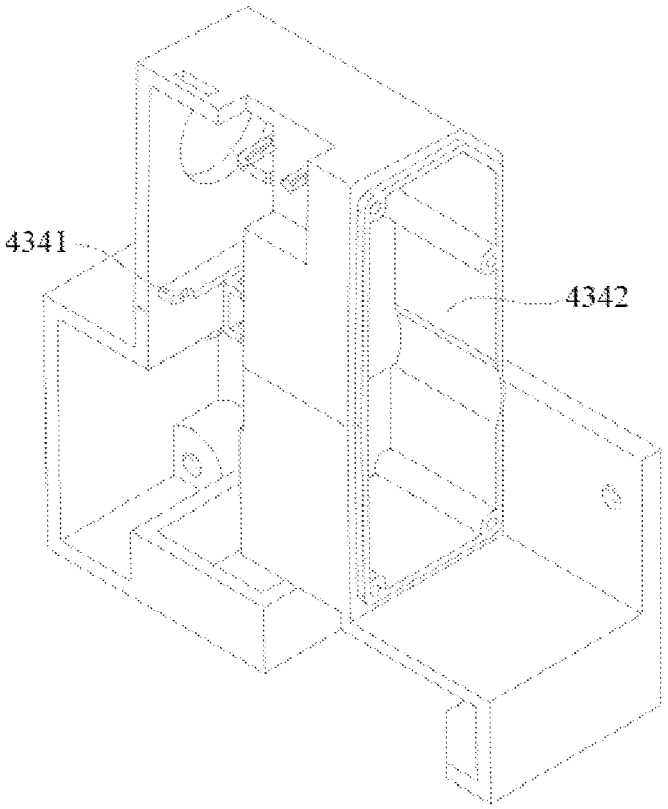
FIG. 34 is a front view of a connecting device according to an embodiment of the present application.

Referring now to FIG. 34, it can be noticed that the connecting mechanism 434 is further provided with a holding cavity 4342 in which a gear set 435 is placed. Placing the gear set 435 in the holding cavity 4342 can save the space inside the garbage can, and also play a certain protective role for the gear set 435.

Referring again to FIG. 32, it clearly shows that the holding cavity 4342 is provided with a locking seat 43421. The locking seat 43421 matches the size of the gear set, so that the gear set rotates smoothly inside.

The side wall of the connecting mechanism 434 is provided with a rotating shaft hole, and a rotating shaft is rotatably connected to the end mechanism 41 through the rotating shaft hole, so as to realize the flipping action of the end mechanism 41.

Referring again to FIG. 34, it can be noticed that the connecting mechanism 434 is provided with a through hole 4343 on the bottom surface.

Figure 35:
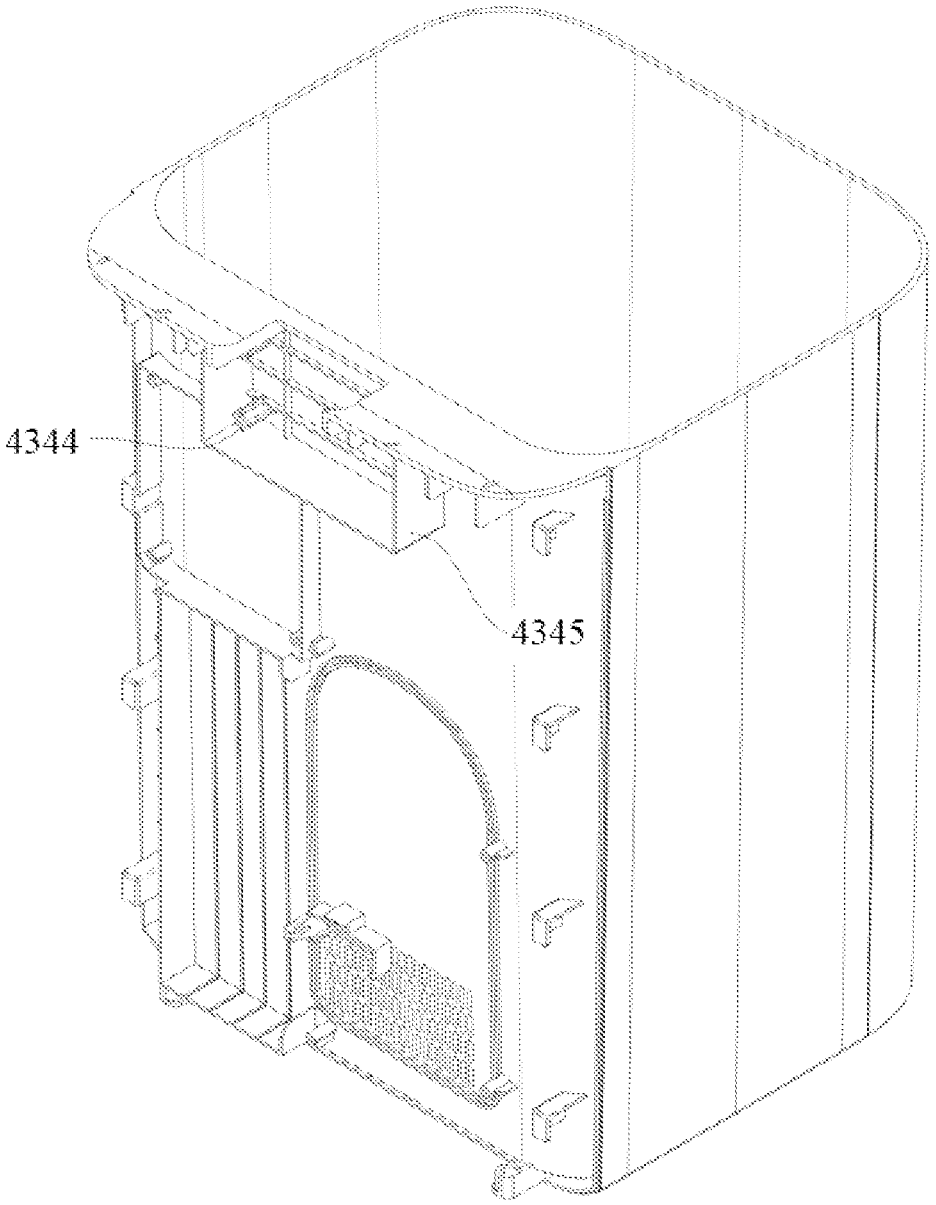
FIG. 35 is a perspective view of an accommodating box proposed according to an embodiment of the present application.
Figure 36:
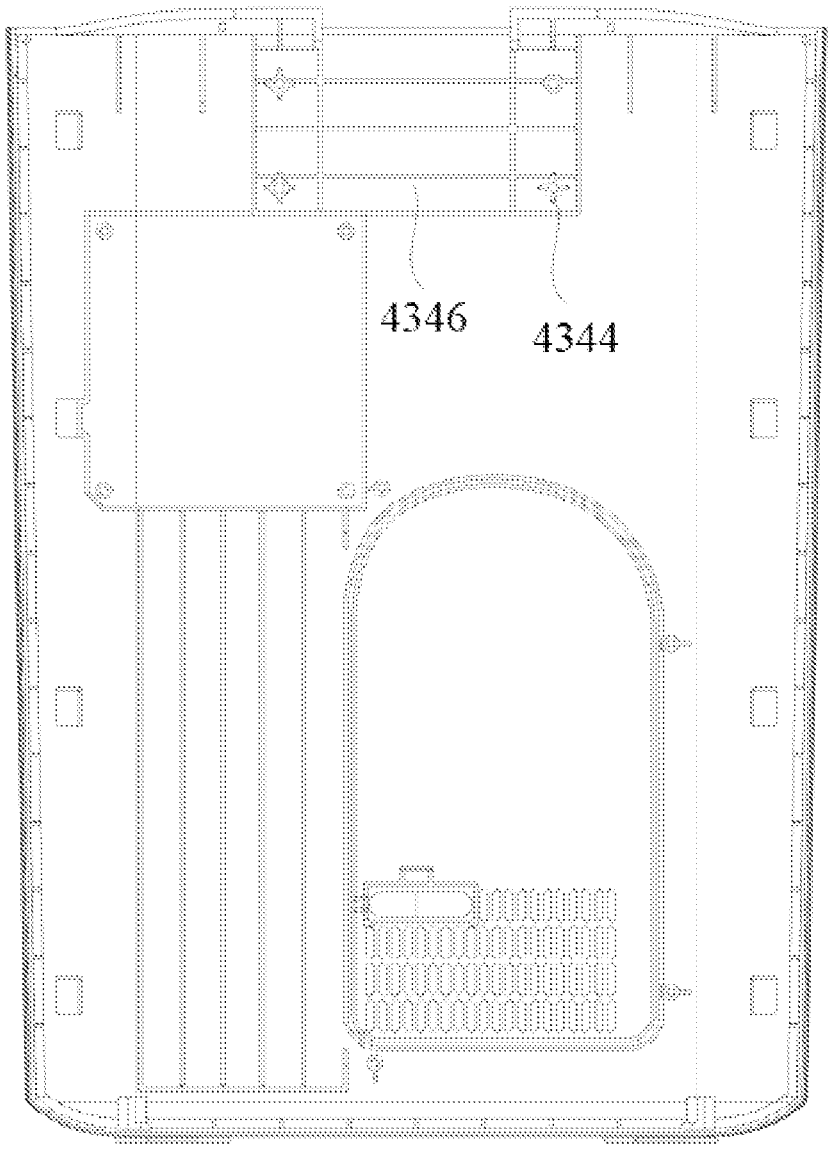
FIG. 36 is a front view of an accommodating box according to an embodiment of the present application.

Referring now to FIG. 35 and FIG. 36, it can be known from what is shown that the accommodating box 43 is provided with a support flange 4345, and the accommodating box 43 is provided with grid ribs 4346.

A blind hole 4344 is provided on the accommodating box 43; wherein the blind hole 4344 is adapted to the through hole 4343 to realize fixed connection of the connecting mechanism.

In a specific embodiment, the connecting device is placed on the support flange 4345, and the blind hole 4344 is matched with the through hole 4343, so that the connecting device is fixed on the accommodating box 43. The grid rib 4346 can make the side wall of the connecting device in a front view direction have supporting points, so as to enhance the strength of the connecting device.

Figure 37:
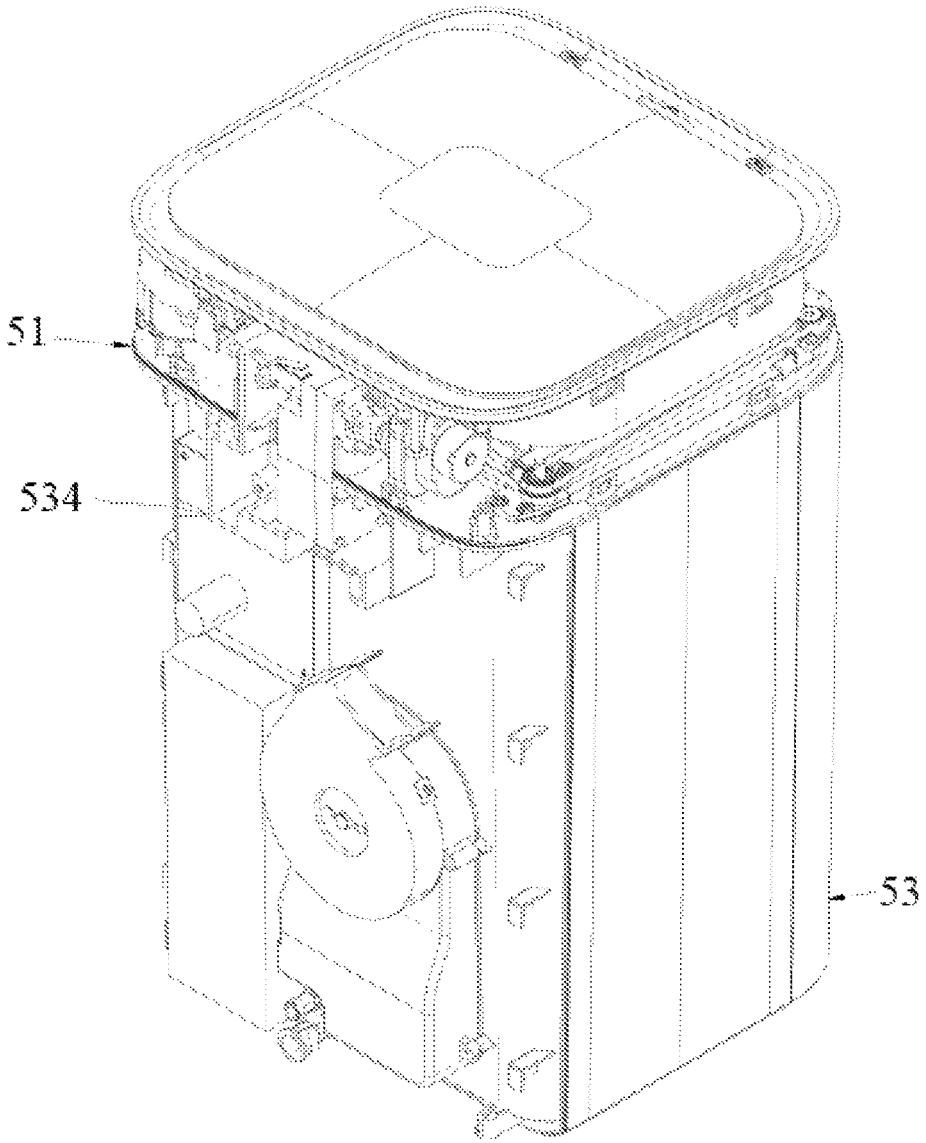
FIG. 37 is a partial perspective view of an intelligent garbage can proposed according to an embodiment of the present application.
Figure 38:
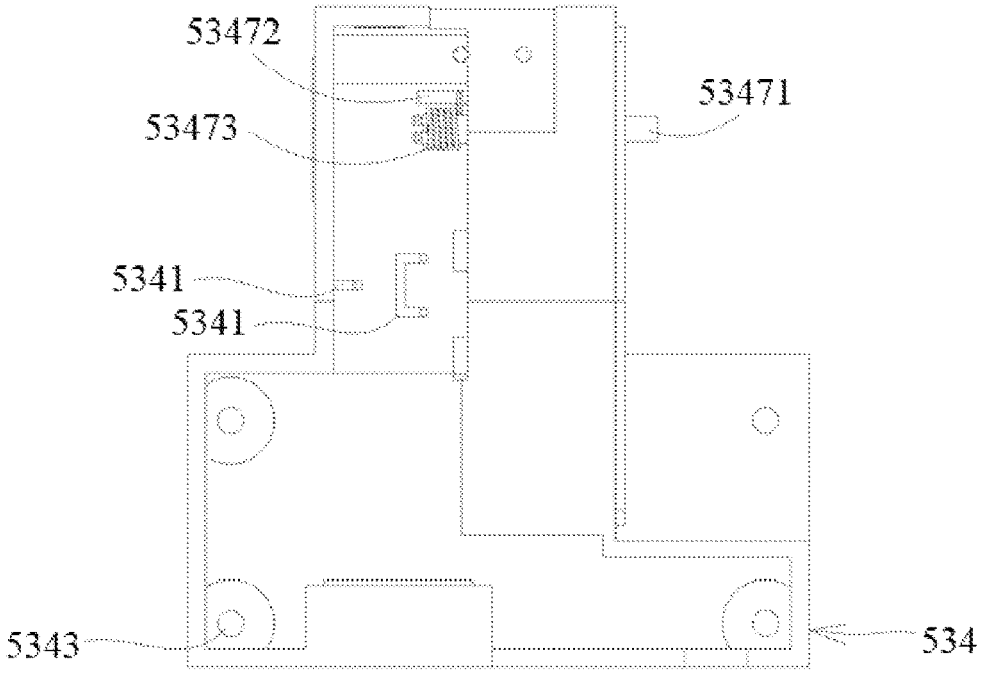
FIG. 38 is a front view of a connecting mechanism proposed according to an embodiment of the present application.

As shown in FIG. 37 and FIG. 38, an embodiment of the present application provides a snap device, and the device may include:

an end mechanism 51;

an accommodating box 53 located under the end mechanism 51; and a connecting mechanism 534 disposed between the end mechanism 51 and the accommodating box 53;

wherein the connecting mechanism 534 is provided with a spring structure 5347 to support the end mechanism 51 when the end mechanism 51 is turned up.

Figure 39:
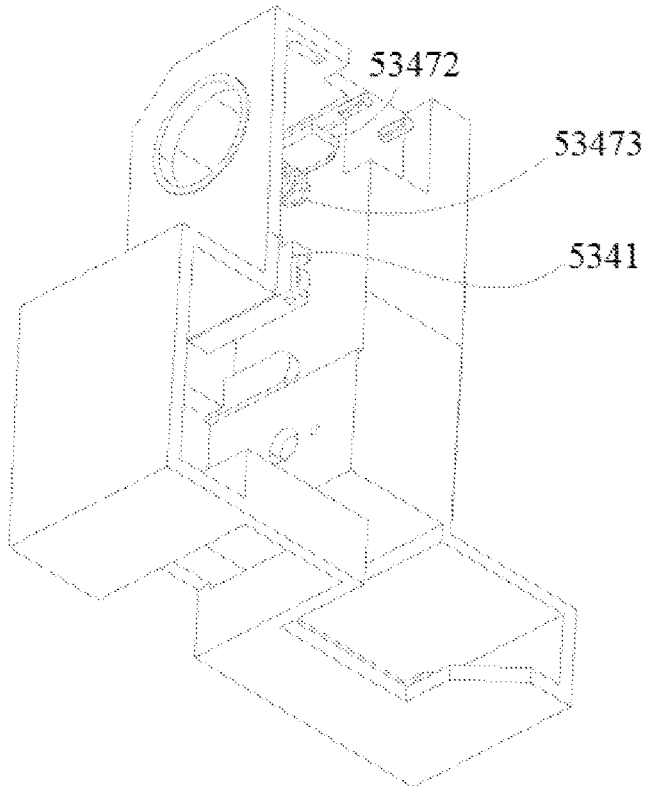
FIG. 39 is a perspective view of a connecting mechanism proposed according to an embodiment of the present application.

Referring again to FIG. 38, in conjunction with FIG. 39, it is clearly shown in detail that the spring structure 5347 includes:

a locking plate 53472 integrally formed with the connecting mechanism 534; and a spring 53473 extending upwardly to form a spring hook;

wherein the spring hook fits with the locking plate 53472.

A notch is formed on the locking plate 53472, and the spring hook is matched with the notch.

Although the position of the notch is not shown in the drawings, it should be understood that, in order to be able to play a limiting role, the spring hook should be provided with a component that can limit the movement of the spring hook.

The spring structure 5347 further includes a rotating shaft 53471, the spring 53473 is fixedly connected with the rotating shaft 53471, the rotating shaft 53471 is fixedly connected with the end mechanism 51, the rotating shaft 53471 is rotatably connected with the rotating shaft hole on the connecting mechanism 534, so as to realize the opening or closing of the end mechanism 51.

In a specific embodiment, since the spring 53473 is fixedly connected with the rotating shaft 53471, the rotating shaft 53471 also rotates with the rotation of the end mechanism 51, and the spring 53473 also rotates with the rotation of the end mechanism 51. When the opening and closing angle of the end mechanism 51 is 90°, the spring hook and the notch are mutually restricted, so that the end mechanism 51 no longer rotates.

Referring again to FIG. 38, it can be clearly seen that the connecting mechanism 534 is provided with a baffle plate 5341 to form a wiring slot.

The baffle plate 5341 can also fix the internal structure, for example, a motor capable of driving the movement of the internal components of the intelligent garbage can. The motor is placed on the baffle plate 5341. On the one hand, the baffle plate 5341 can also play a certain supporting role for the motor; and on the other hand, the wiring slot formed by the baffle plates 5341 can also arrange the circuit wires connected to the motor in an orderly manner, so that the wiring inside the intelligent garbage can is not entangled and the occurrence of faults is reduced.

Figure 40:
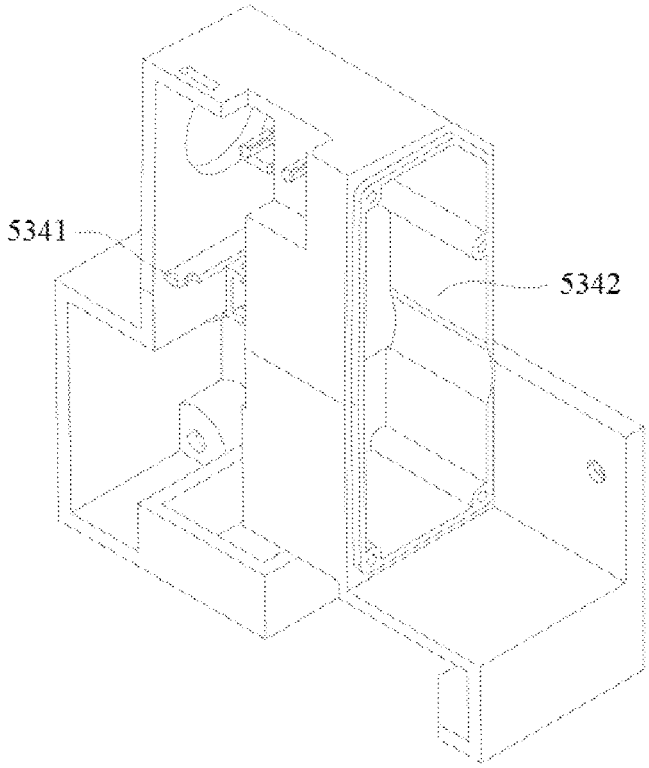
FIG. 40 is a perspective view of a connecting mechanism proposed according to an embodiment of the present application.

As shown in FIG. 40, the connecting mechanism 534 is further provided with a holding cavity 5342.

Figure 41:
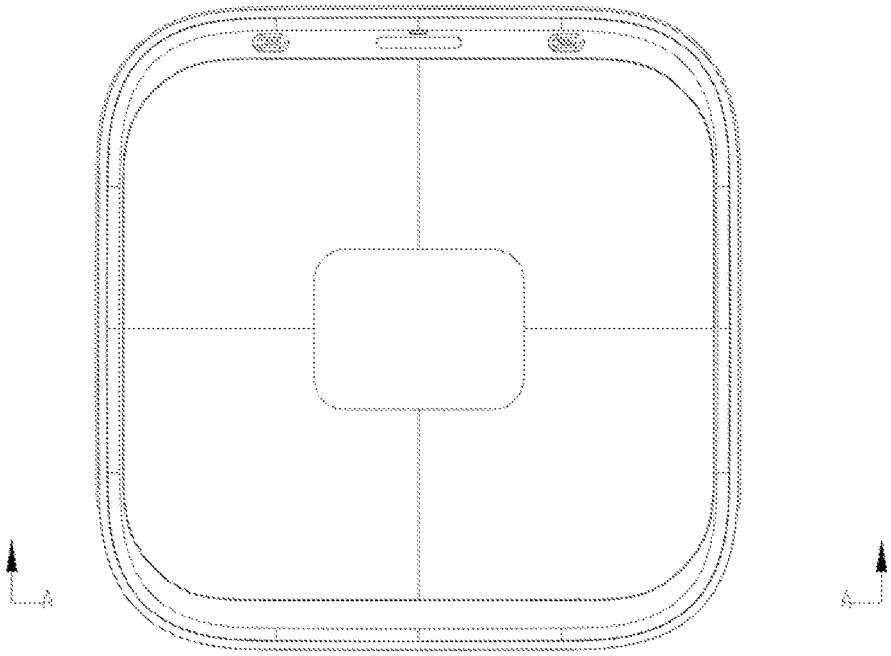
FIG. 41 is a top view of an intelligent garbage can proposed according to an embodiment of the present application.
Figure 42:
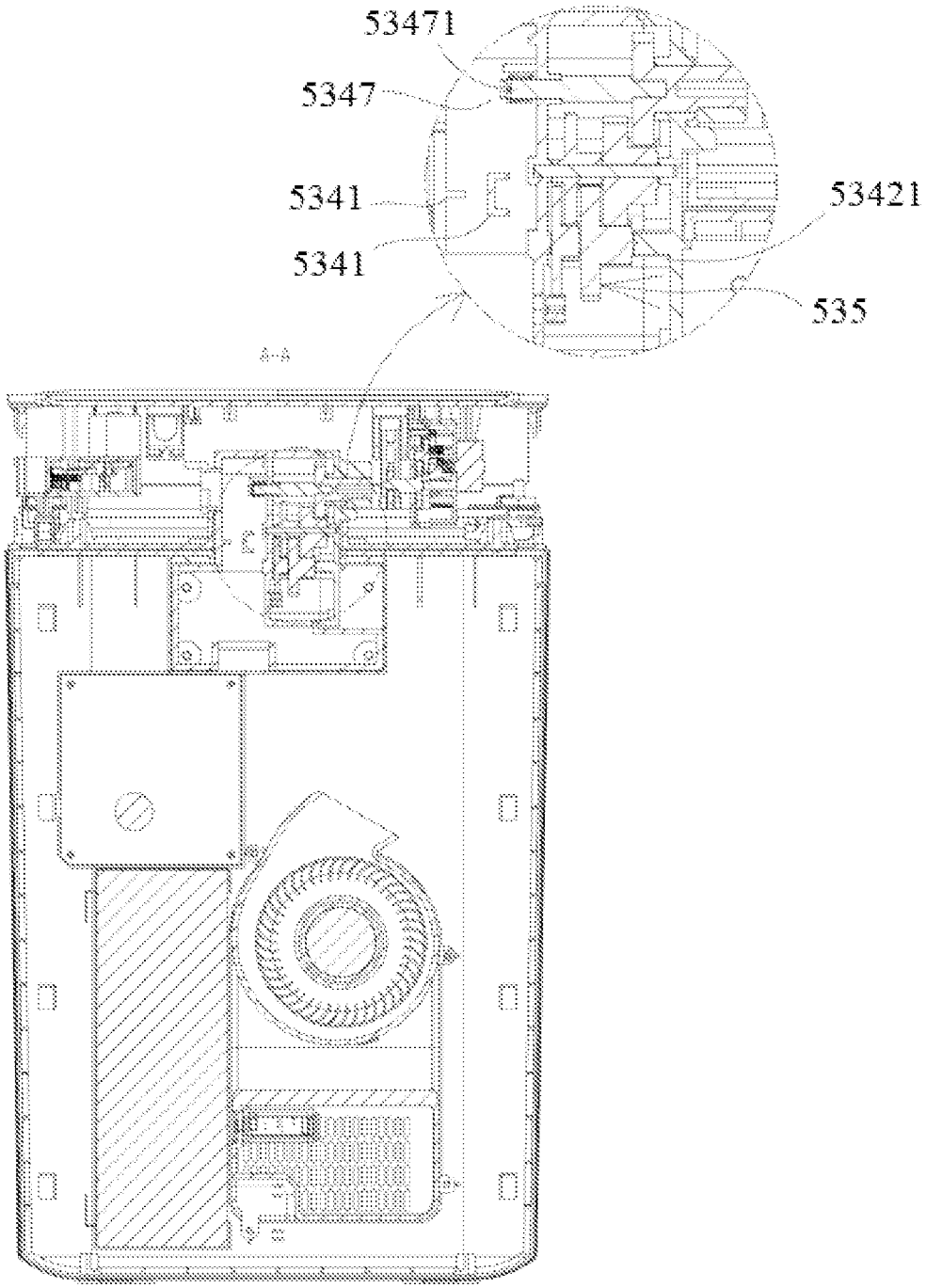
FIG. 42 is a cross-sectional view taken along line A-A of an intelligent garbage can proposed according to an embodiment of the present application.

Referring now to FIG. 41 and FIG. 42, it can be noted that the gear set 535 is placed in the receiving cavity 5342. Placing the gear set 535 in the holding cavity 5342 can save the space inside the garbage can, and also play a certain protective role for the gear set 535.

The holding cavity 5342 is provided with a locking seat 53421, and the locking seat 53421 is matched with the size of the gear set, so as to make the gear set rotate smoothly inside.

The connecting mechanism 534 is in a convex shape as a whole.

Wherein an upper portion of the connecting mechanism 534 is rotatably connected with the end mechanism 534.

A lower portion of the connecting mechanism 534 is fixedly connected with the accommodating box 53.

Figure 43:
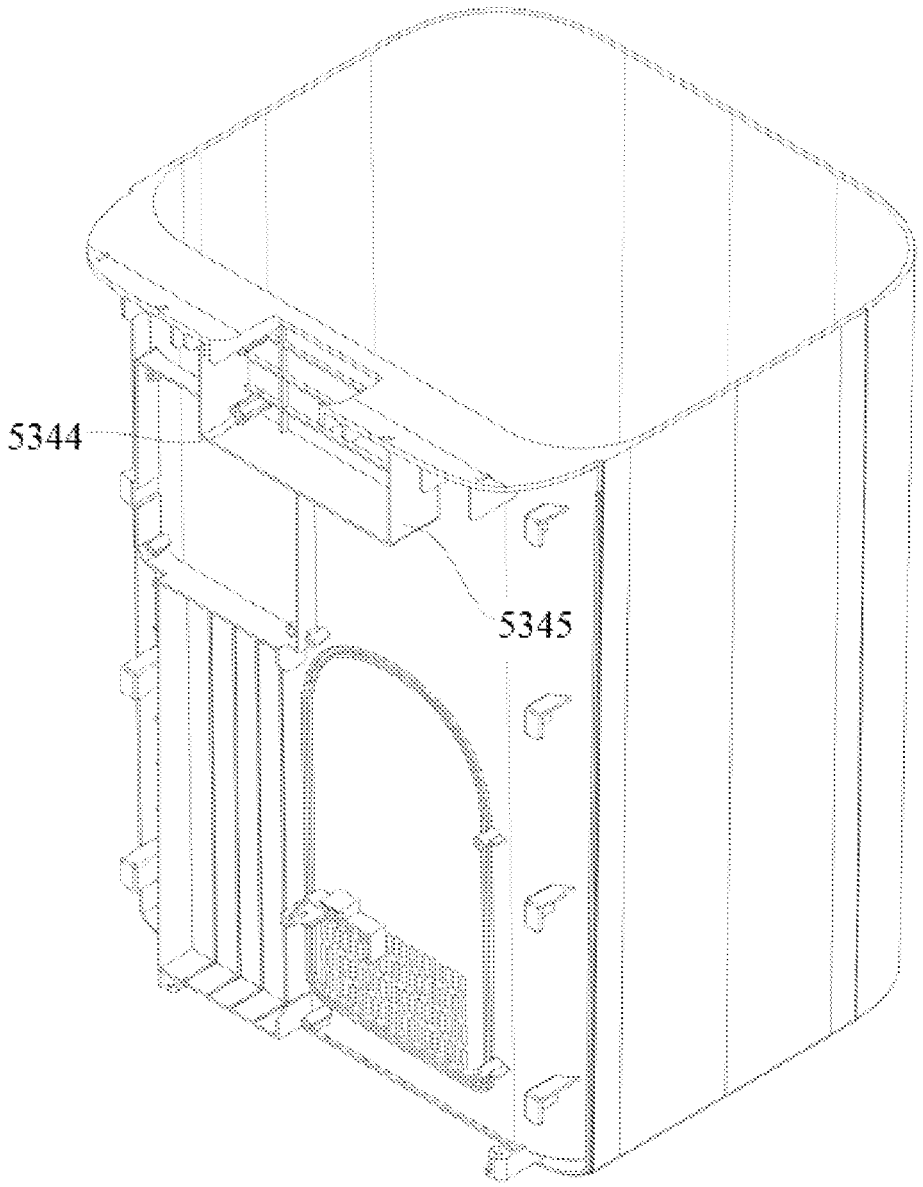
FIG. 43 is a perspective view of an accommodating box proposed according to an embodiment of the present application.
Figure 44:
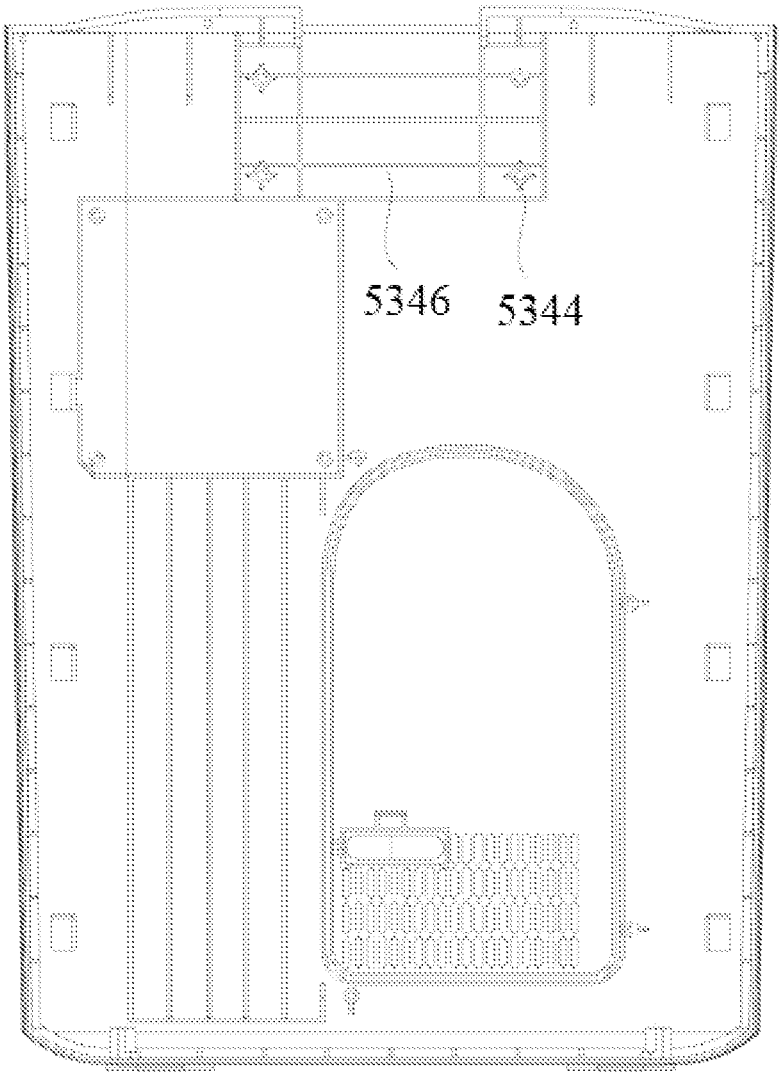
FIG. 44 is a front view of an accommodating box proposed according to an embodiment of the present application.

Referring now to FIG. 43, it can be clearly seen that the accommodating box 53 is provided with a support flange 5345. As shown in FIG. 44, the accommodating box 53 is provided with grid ribs 5346.

In a specific embodiment, the connecting mechanism 534 is placed on the support flange 5345 and connected by screws, so that the connection device is fixed on the accommodating box 53. The grid ribs 5346 can make the side wall of the connecting device in the front view direction have supporting points, so as to enhance the strength of the connecting device.

Figure 45:
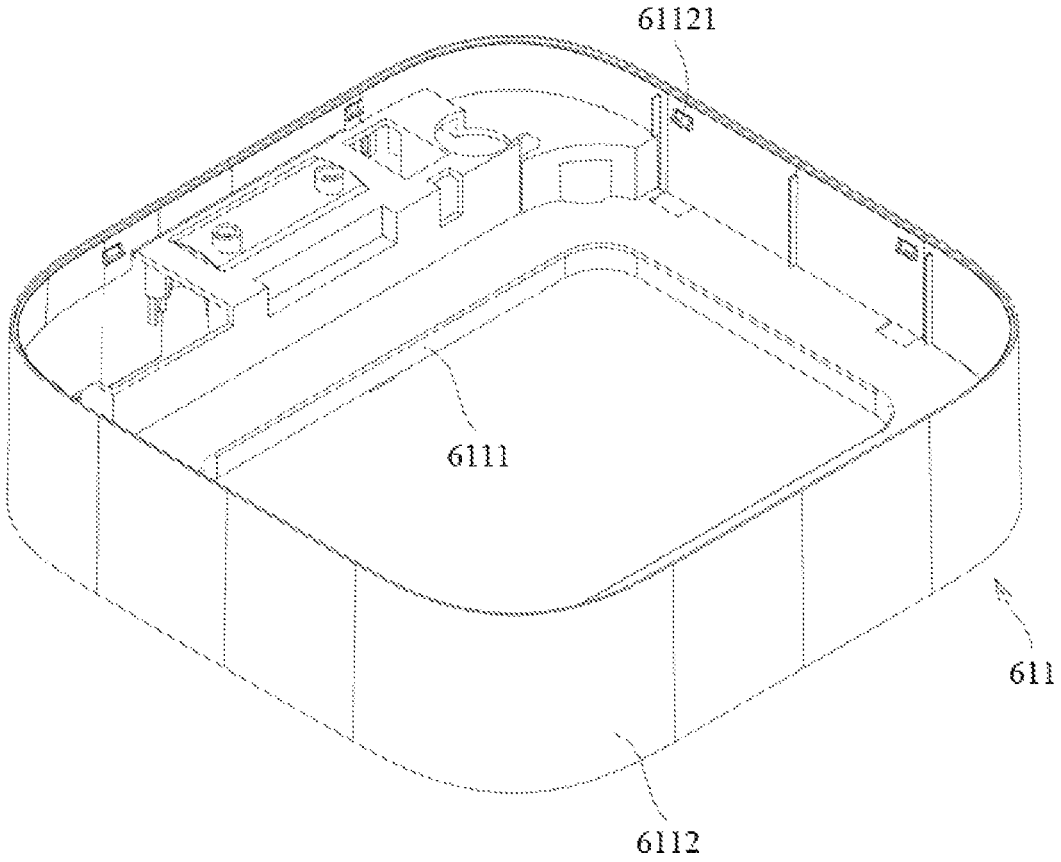
FIG. 45 is a perspective view of an end cap frame proposed according to an embodiment of the present application.
Figure 46:
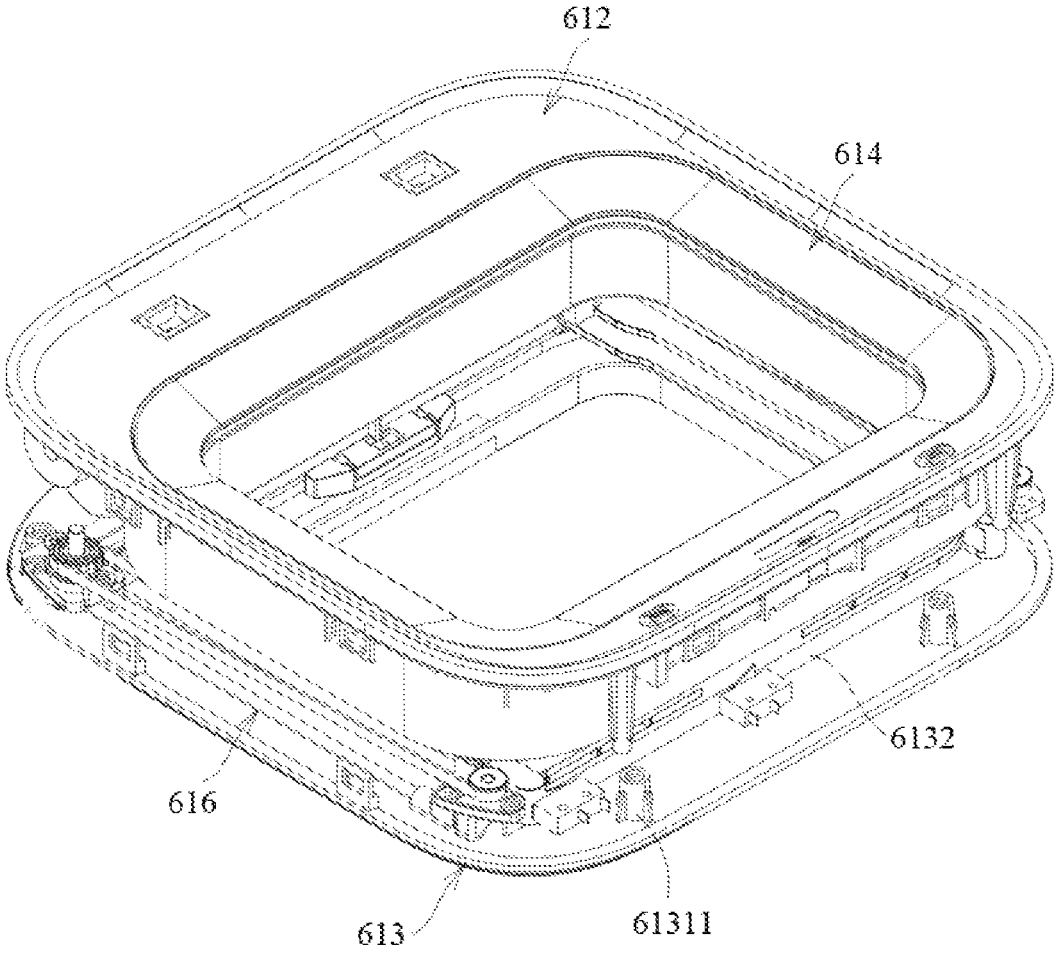
FIG. 46 is a partial perspective view of a holding device for mounting a conveyor belt according to an embodiment of the present application.
Figure 47:
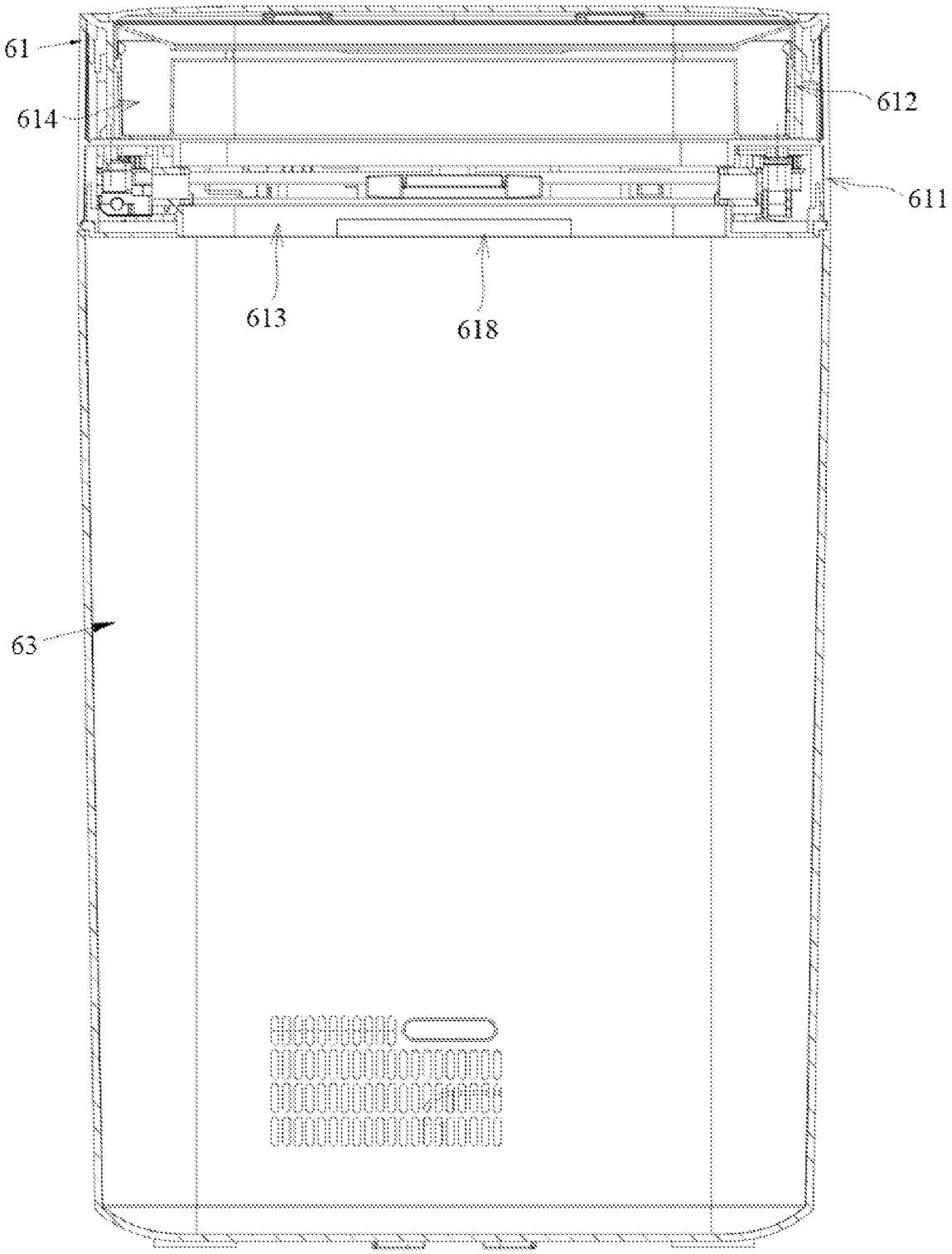
FIG. 47 is a cross-sectional view of an intelligent garbage can proposed according to an embodiment of the present application.

As shown in FIG. 45, FIG. 46 and FIG. 47, an embodiment of the present application provides a holding device for mounting a conveyor belt, and the device may include:

an end cap frame 611, an interior of the end cap frame 611 being hollow, and a middle portion of the end cap frame 611 being horizontally provided with a separation layer 6111;

a first member 612, a middle of the first member 612 being hollow, the first member 612 being disposed above the separation layer 6111; and a second member 613, a middle of the second member 613 being hollow, the second member 613 being disposed below the separation layer 6111.

Figure 48:
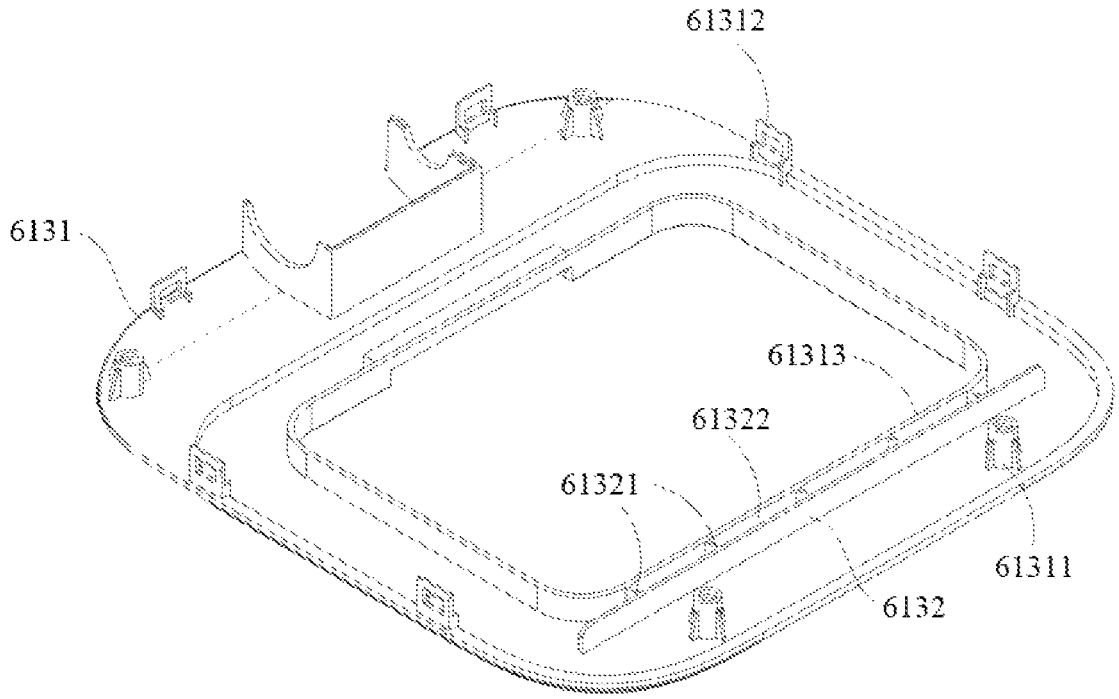
FIG. 48 is a perspective view of a second member according to an embodiment of the present application.
Figure 49:
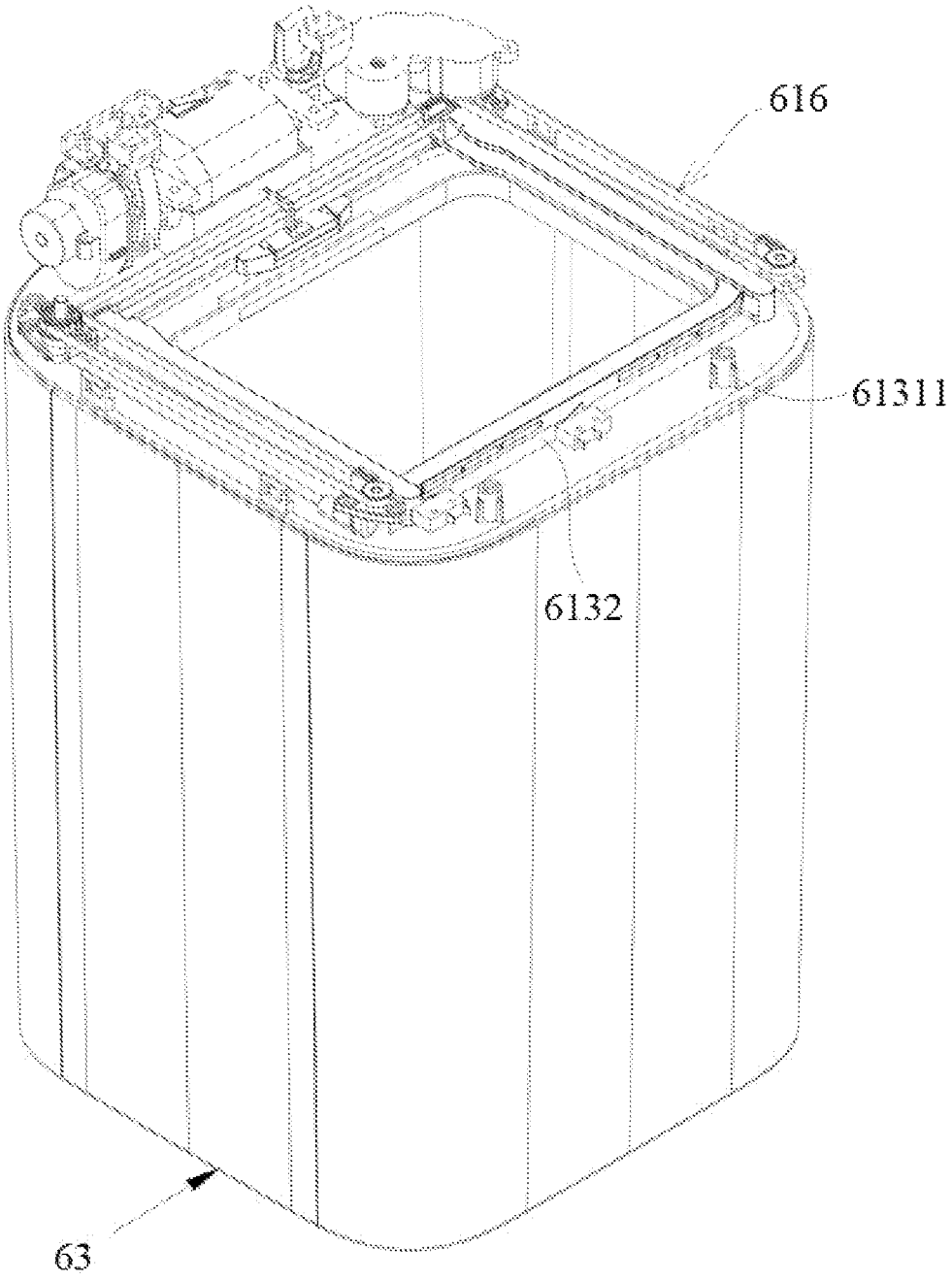
FIG. 49 is a partial perspective view of an intelligent garbage can proposed according to an embodiment of the present application.

Referring to FIGS. 48 and 49, it can be noticed that the second member 613 is provided with a mounting plate 6132. An inner circle of the second member 613 is provided with an inner circle flange 61313. The mounting plate 6132 and the inner circle flange 61313 form a mounting groove 61322.

The separation layer 6111 provides a guarantee for the stability of the first member 612 and the second member 613 in the end cap frame 611, and has a certain support for the first member 612, thereby reducing the supporting effect of the second member 613 on the first member 612.

Partitions 61321 are disposed in the mounting groove 61322 at intervals.

In a specific embodiment, the conveyor belt 616 is mounted on the mounting slot 61322. The partitions 61321 are provided under the conveyor belt 616 to support the conveyor belt 16, which can improve the stability of the conveyor belt 616, increase the service life of the conveyor belt 616, and reduce costs.

Figure 50:
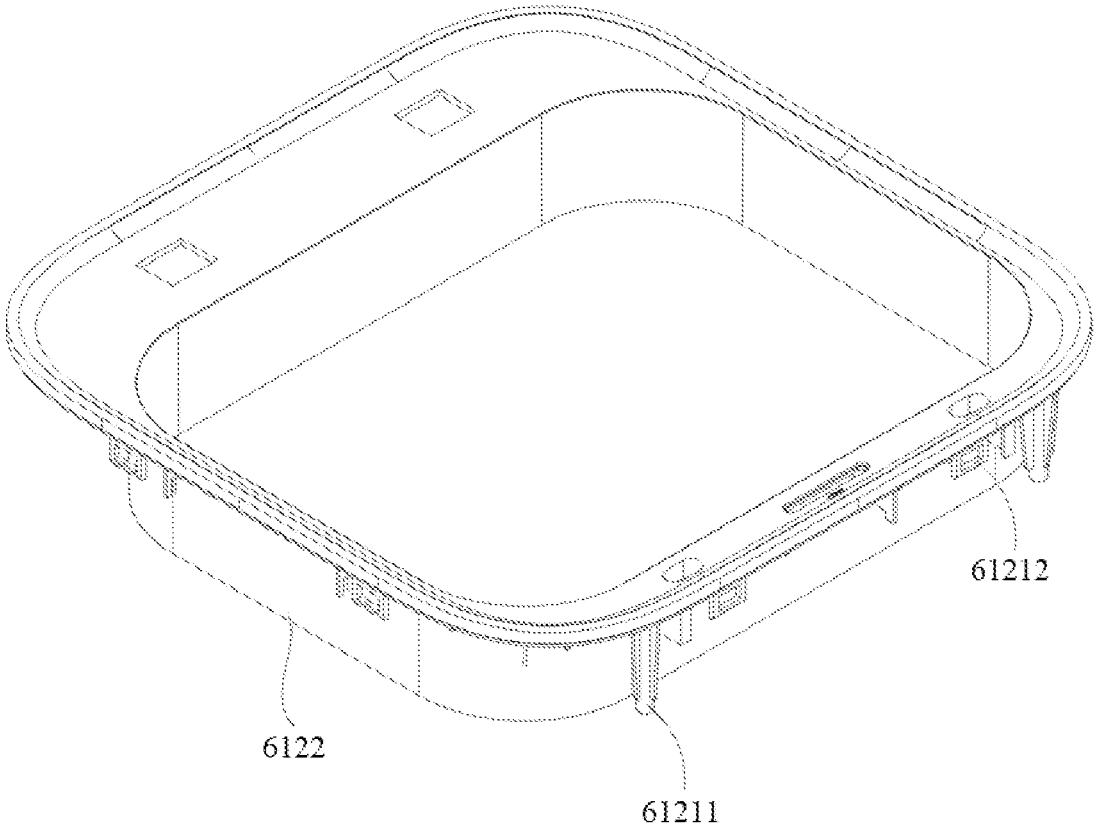
FIG. 50 is a perspective view of a first member proposed according to an embodiment of the present application.

According to the illustration in FIG. 50, it can be clearly understood that the first member 612 is provided with a skirt 6122 extending axially and downwardly. The first member 612 is provided with first support feet 61211 extending downwardly in the axial direction. The supporting feet 61211 are distributed around the skirt 6122 in a circular array and are integrated with the first member 612.

The first member 612 is provided with first snaps 61212 at intervals, and the first snaps 61212 are distributed in a circular array.

Referring again to FIGS. 46 and 47, in a specific structure, a garbage bag box 614 is set up in the hollow of the first member 612. The purpose of the skirt 6122 is that when the garbage bag box 614 leaves the first member 612, the skirt 6122 can also make the sealing of the end cap device 61 so as not to allow dust or water stains to enter the interior of the end cap and protect the internal circuits.

The second member 613 is provided with second support feet 61311 disposed at intervals, distributed in a circular array and extending upwardly in the axial direction.

There is still a gap between the support feet 61311 and the mounting plate 6132. The gap is used to place the line connecting the conveyor belt 616, so that the inner circle realizes the movement of the conveyor belt 616, and the outer circle realizes the direction of the line, making full use of the internal space, improving the space utilization rate inside the garbage can, and saving costs.

Referring now to FIG. 48 again, it can be clearly understood that the second member 613 is provided with second snaps 61312 at intervals.

The second snaps 61312 are distributed in a circular array.

Figure 51:
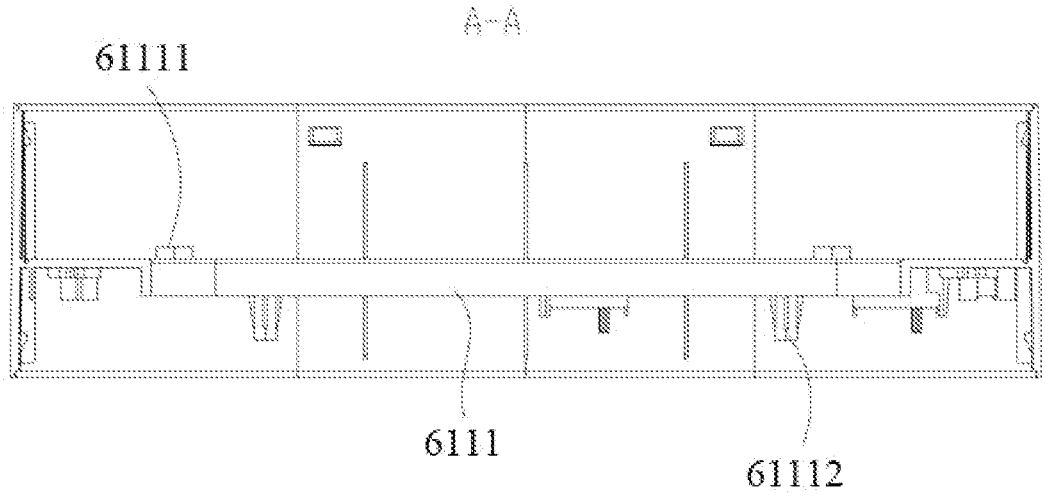
FIG. 51 is a top view of an end cap frame proposed according to an embodiment of the present application.
Figure 52:
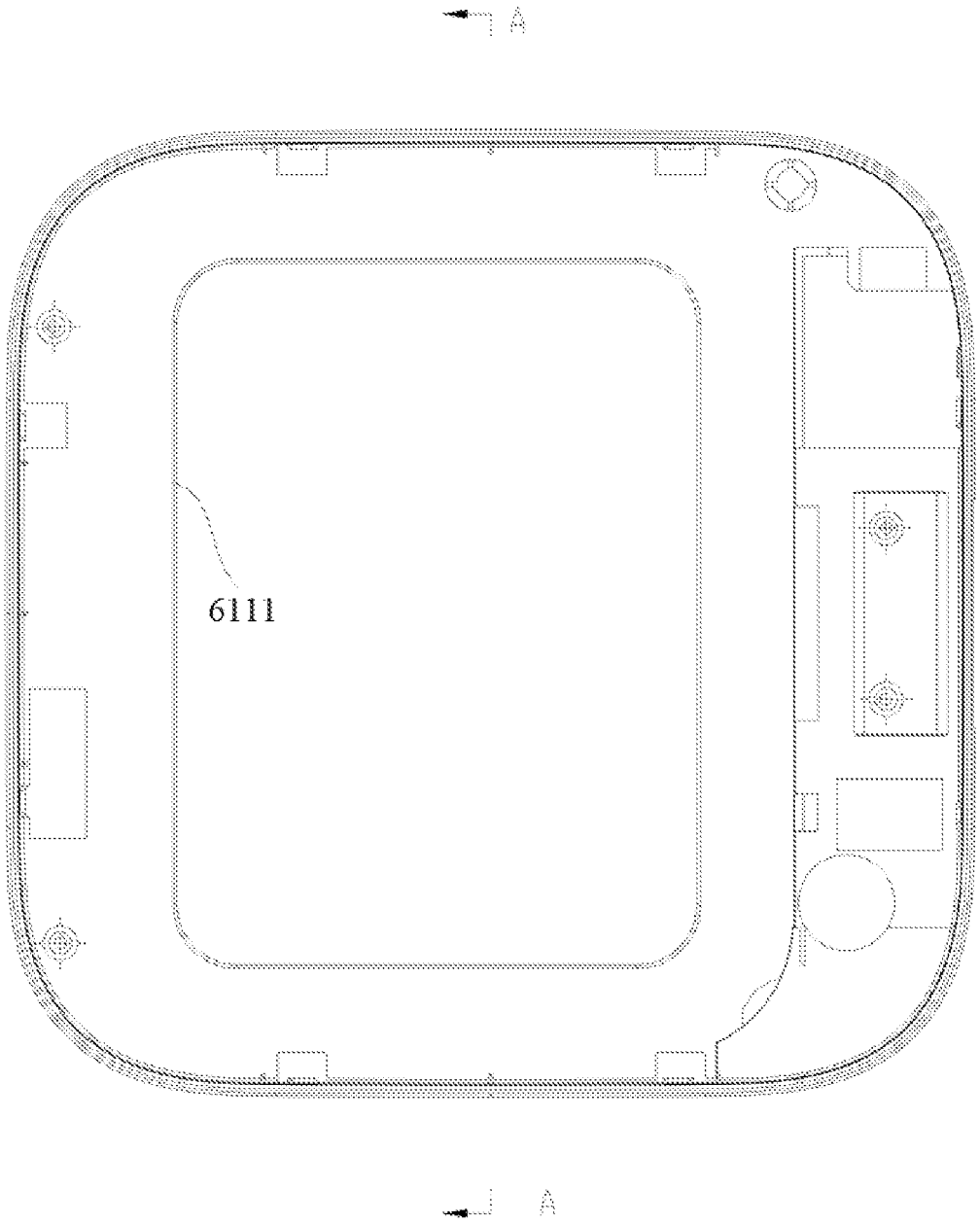
FIG. 52 is a cross-sectional view taken along line A-A of an end cap frame proposed according to an embodiment of the present application.

Referring now to FIGS. 51 and 52, it can be clearly drawn that the end cap frame 611 is provided with a side wall 6112. The side wall 6112 is provided with hook structures 61121.

A cross-sectional area of the hook structure 61121 gradually decreases inwardly along the radial direction.

The hook structures 61121 are respectively matched with the first snap 61212 and the second snap 61312.

An upper end surface of the separation layer 6111 of the end cap frame 611 is provided with a partition support base 61111.

A lower end surface of the separation layer 6111 of the end cap frame 611 is provided with a partition support portion 61112.

Wherein the partition support base 61111 is matched with the first support feet 61211, and the partition support portion 61112 is matched with the second support base 61311.

The cooperation of the snap structure and the support feet as well as the support seat are all to strengthen the stability between the various parts of the end of the intelligent garbage can.

Figure 53:
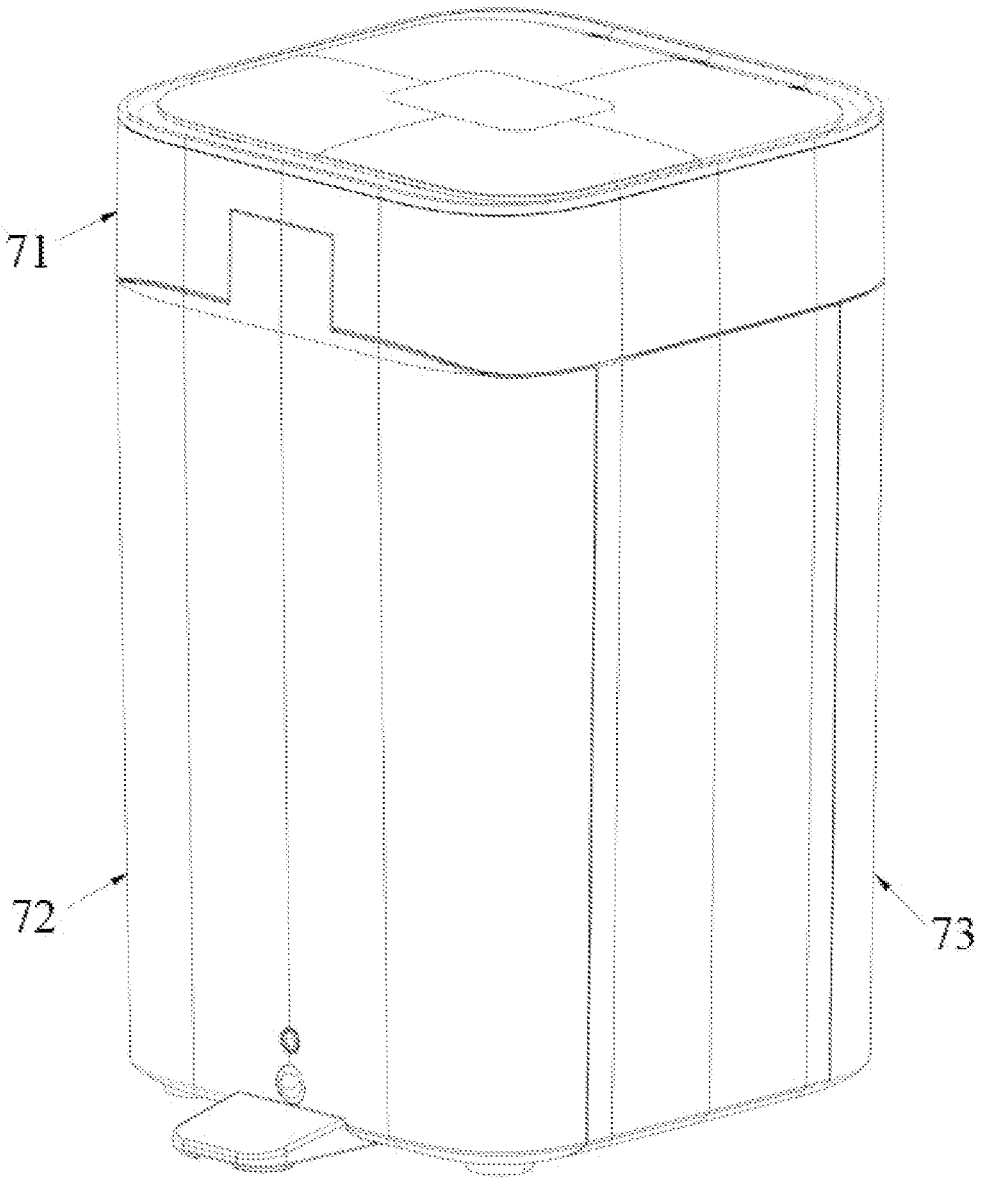
FIG. 53 is a perspective view of an intelligent garbage can proposed according to an embodiment of the present application.
Figure 54:
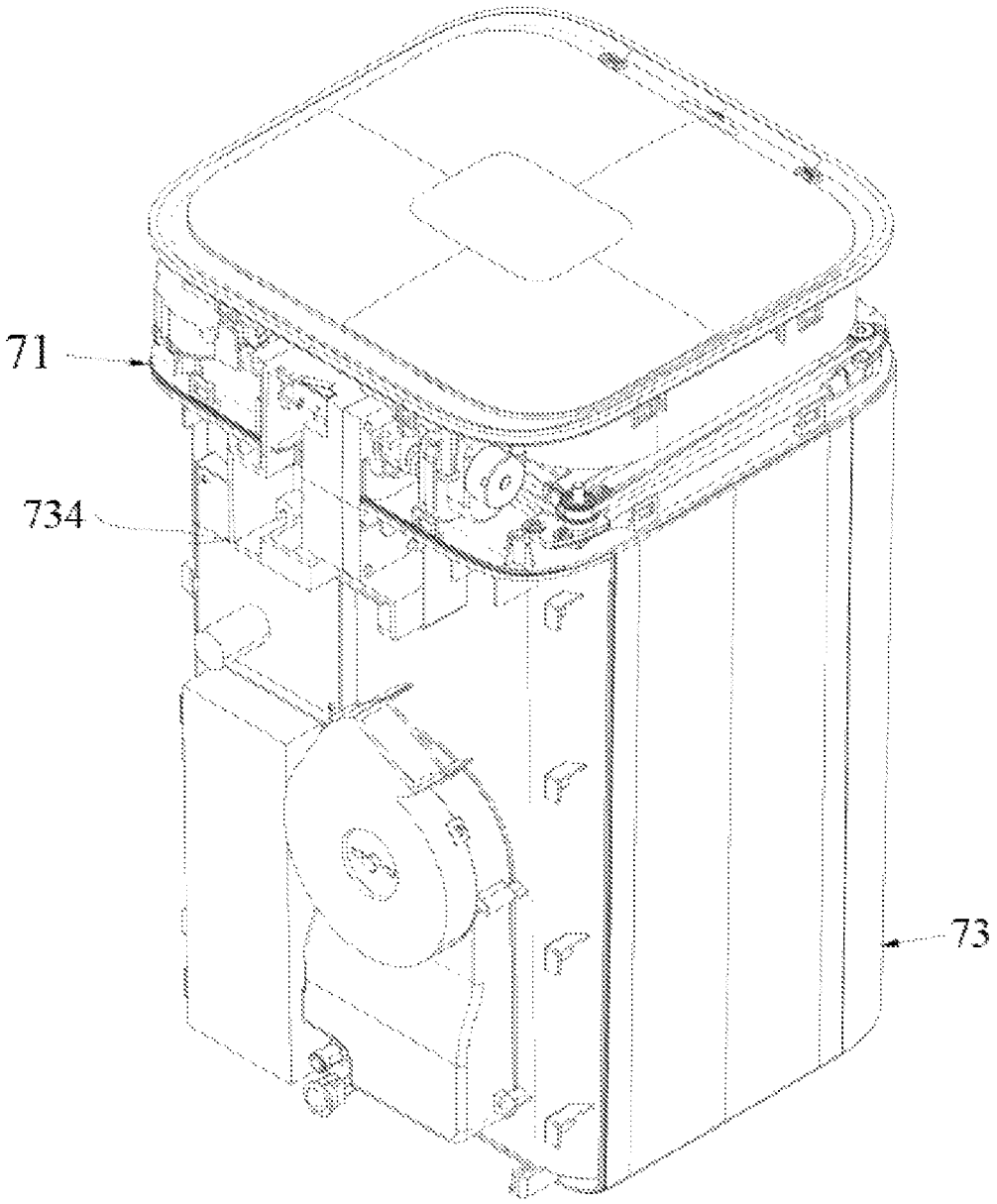
FIG. 54 is a partial perspective view of an intelligent garbage can proposed according to an embodiment of the present application.

As shown in FIG. 53 and FIG. 54, an embodiment of the present application provides a positioning device, and the device may include:

an end mechanism 71;

an accommodating box 73 disposed under the end mechanism 71; and a connecting mechanism 734 located between the end mechanism 71 and the accommodating box 73.

Figure 55:
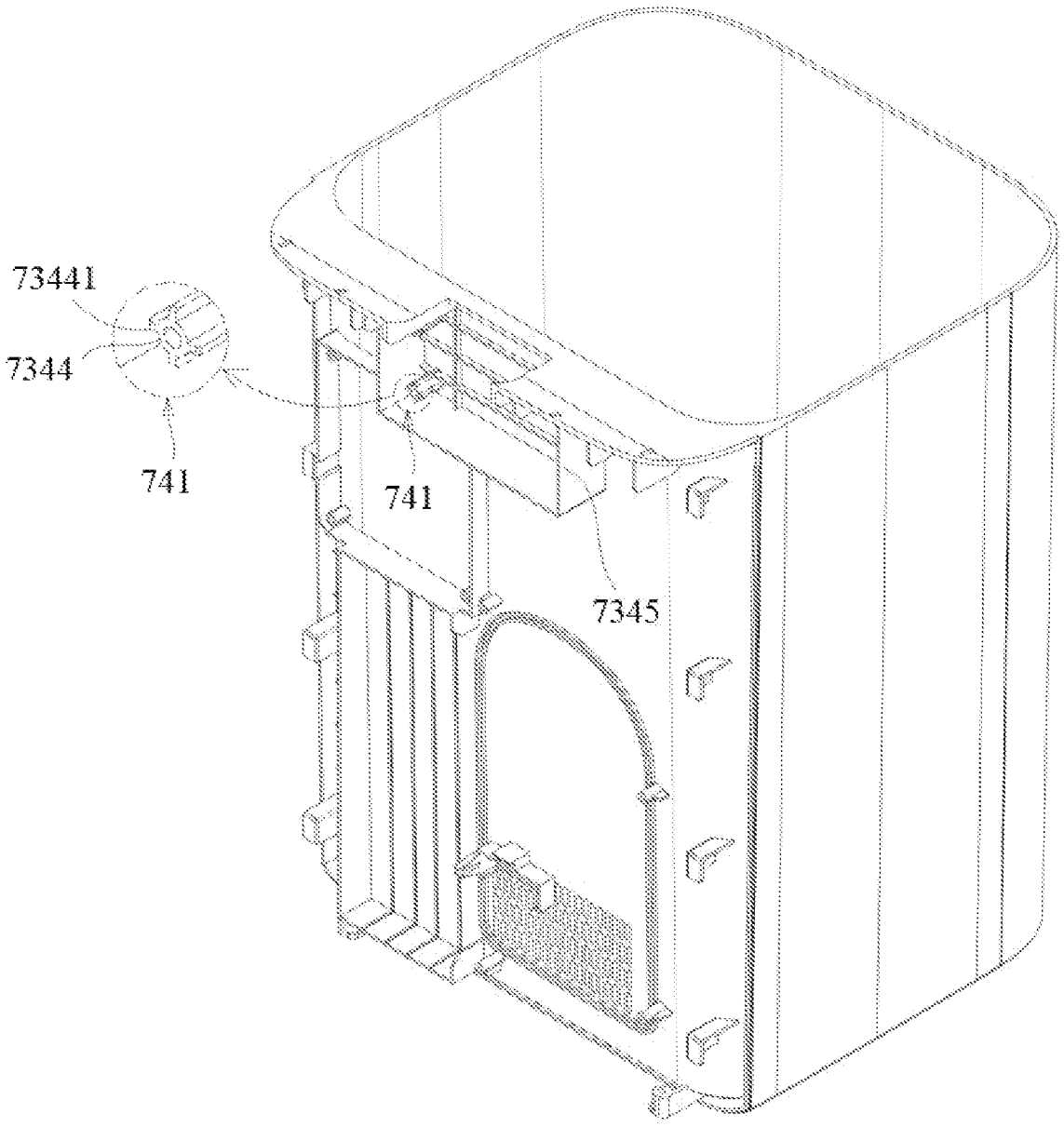
FIG. 55 is a perspective view of an accommodating box proposed according to an embodiment of the present application.

Referring to FIG. 55, it can be noted that at least two positioning mechanisms 7344 are provided on the accommodating box 73. The positioning mechanism 7344 is disposed on the front surface of the connecting mechanism 734 at intervals.

The positioning mechanism 7344 is a blind hole, and its outer periphery is provided with reinforcing ribs 73441 at intervals. At least three reinforcing ribs 73441 are provided. In a specific embodiment, four reinforcing ribs 73441 are provided, which is more in line with conventional settings.

Figure 56:
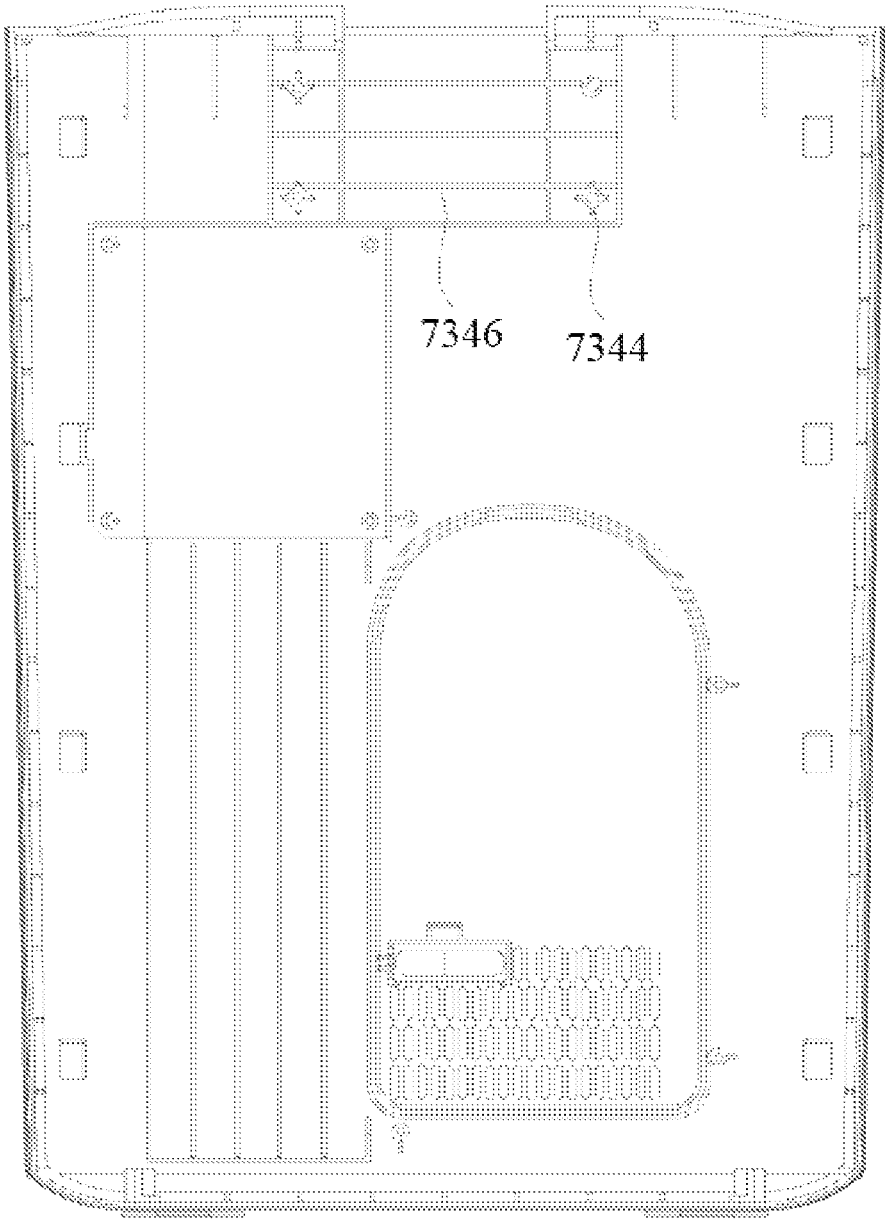
FIG. 56 is a front view of an accommodating box proposed according to an embodiment of the present application.

Referring now to FIG. 55, with reference to FIG. 56, it can be clearly understood that the accommodating box 73 is provided with a support flange 7345. The accommodating box 73 is provided with grid ribs 7346. The positioning mechanism 7344 is provided at a lower portion of the grid ribs 7346.

In a specific embodiment, by positioning the connecting mechanism 734 positioned in the accommodating box 73 through the positioning mechanism 7344, by placing the connecting mechanism 734 on the support flange 7345, and by the matching of the blind hole and the through hole 7343 on the positioning mechanism 7344, the connecting mechanism is fixed on the accommodating box 73. The grid ribs 7346 can make the side wall of the connecting device in the front view direction have supporting points, so as to enhance the strength of the connecting device.

Wherein, at least two positioning mechanisms are provided. Preferably, three positioning mechanisms 7344 are provided. The three positioning mechanisms 7344 further and more securely install the connecting mechanism 734 on the accommodating box 733 without causing a substantial increase in cost.

Figure 57:
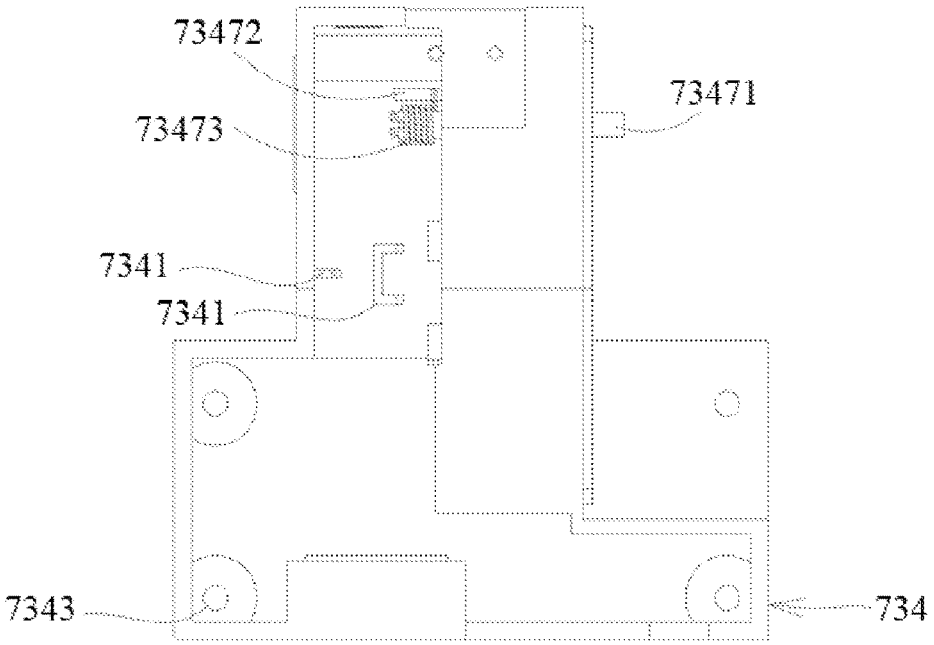
FIG. 57 is a front view of a connecting mechanism proposed according to an embodiment of the present application.
Figure 58:
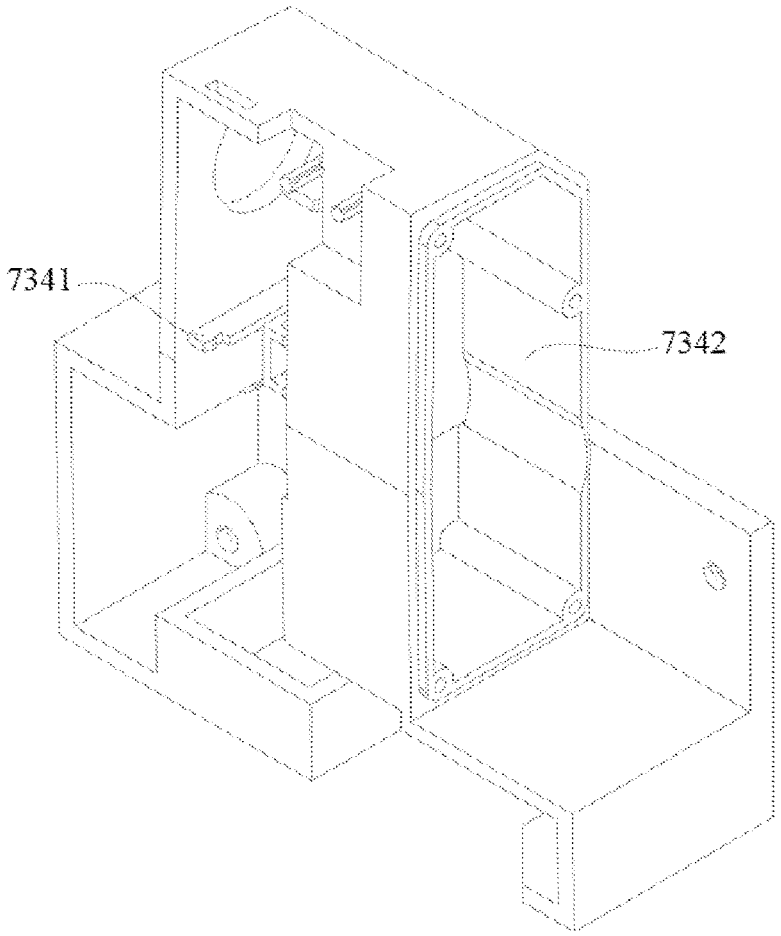
FIG. 58 is a perspective view of a connecting mechanism proposed according to an embodiment of the present application.

As shown in FIG. 57 and FIG. 58, the connecting mechanism 734 has a convex shape as a whole. An upper portion of the connecting mechanism 734 is rotatably connected with the end mechanism 734. A lower portion of the connecting mechanism 734 is fixedly connected with the accommodating box 73. The connecting mechanism 734 is also provided with a holding cavity 7342 in which a gear set 735 is placed. A locking seat 73421 is also provided in the holding cavity 7342. The locking seat 73421 matches the size of the gear set, so that the gear set rotates smoothly inside.

The connecting mechanism 734 is provided with a through hole 7343 on the bottom surface thereof. The through hole 7343 is matched with the positioning mechanism 7344. The through hole 7343 and the positioning mechanism 7344 are fixedly connected by screws on the through hole 7343 and the positioning mechanism 7344.

Figure 59:
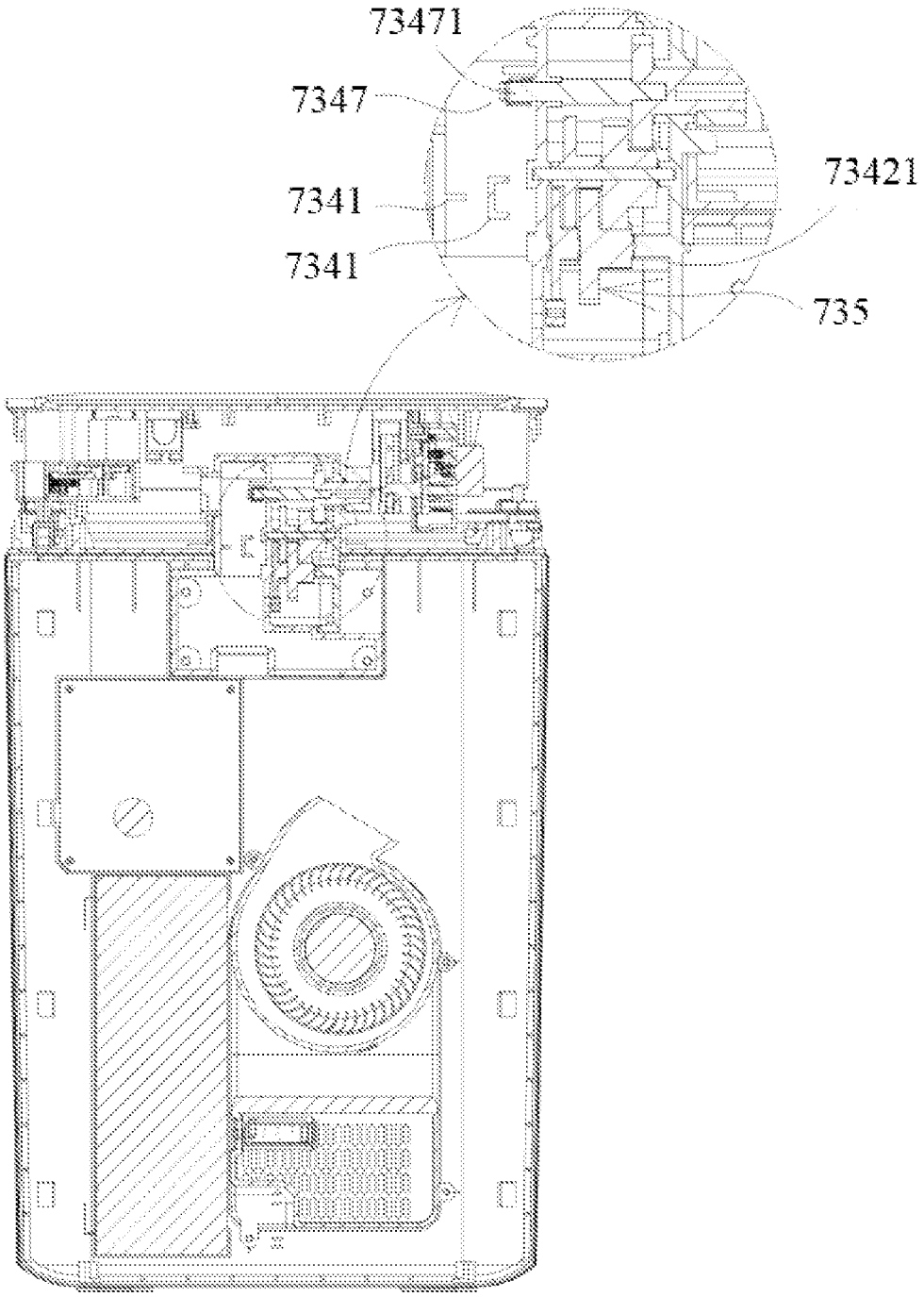
FIG. 59 is a cross-sectional view of an intelligent garbage can according to an embodiment of the present application.

Referring to FIG. 59 again, in conjunction with FIG. 57, it can be clearly understood that the spring structure 7347 includes a locking plate 73472 integrally formed with the connecting mechanism 734. The spring 73473 extends upwardly to form a spring hook. Among them, the spring hook is adapted to the locking plate 73472. The locking plate 73472 is provided with a notch, and the spring hook is matched with the notch.

Although the position of the notch is not shown in the drawings, it should be understood that, in order to be able to play a limiting role, the spring hook should be provided with a component that can limit the movement of the spring hook.

The spring structure 7347 further includes a rotating shaft 73471, the spring 73473 is fixedly connected with the rotating shaft 73471, the rotating shaft 73471 is fixedly connected with the end mechanism 71, and the rotating shaft 73471 is rotatably connected with the rotating shaft hole on the connecting mechanism 734, so as to realize opening or closing of the end mechanism 71.

In a specific embodiment, since the spring 73473 is fixedly connected with the rotating shaft 73471, the rotating shaft 73471 also rotates with the rotation of the end mechanism 71, and the spring 73473 also rotates with the rotation of the end mechanism 71. When the opening and closing angle of the end mechanism 71 is 90°, the spring hook and the notch are mutually restricted, so that the end mechanism 71 no longer rotates.

Referring again to FIGS. 57 and 58, the connecting mechanism 734 is provided with a baffle plate 7341 to form a wiring slot. The baffle plate 7341 can also fix the internal structure, for example, a motor capable of driving the movement of the internal components of the intelligent garbage can. The motor is placed on the baffle plate 7341. On the one hand, the baffle plate 7341 can also play a certain supporting role for the motor; and on the other hand, the wiring slot formed by the baffle plates 7341 can also arrange the circuit wires connected to the motor in an orderly manner, so that the wiring inside the intelligent garbage can is not entangled and the occurrence of faults is reduced.

Although the embodiments of the present application have been disclosed above, they are not limited to the applications listed in the description and the embodiments, and can be applied to various fields suitable for the present application. Additional modifications can readily be implemented by those skilled in the art. Therefore, the application is not limited to the specific details and illustrations shown and described herein without departing from the general concept defined by the claims and the scope of equivalents.

What is claimed is:

1. A connecting device, comprising:

an end mechanism;

an accommodating box disposed under the end mechanism; and a connecting mechanism located between the end mechanism and the accommodating box, the end mechanism being connected to the connecting mechanism;

wherein the connecting mechanism is provided with at least two baffle plates, and the baffle plates form a wiring slot;

wherein the at least two baffle plates comprise a first baffle plate extending along a horizontal direction and a second baffle plate extending along a vertical direction perpendicular to the horizontal direction; at least one of the first baffle plate and the second baffle plate is configured to support a motor to which a wire is connected; the motor is configured to drive the end mechanism to rotate with respect to the accommodating box; a height of the second baffle plate along the vertical direction is larger than a thickness of the first baffle plate along the vertical direction; the wiring slot is formed between the first baffle plate and the second baffle plate to receive the wire in a manner that the wire extends through the wiring slot along the second baffle plate and the wire is restricted by the first baffle plate.

2. The connecting device of claim 1, wherein the connecting mechanism has a convex shape as a whole, the connecting mechanism comprises a lower portion and an upper portion extending from the lower portion along the vertical direction; the lower portion is wider than the upper portion along the horizontal direction; the accommodating box comprises a top wall, a rear wall integrally connecting with the top wall, and a support flange integrally connecting with the top wall and the rear wall; the support flange is located below the top wall and comprises a first side wall, a second side wall opposite to the first side wall, a bottom wall connecting the first side wall and the second side wall, and a receiving space at least partially formed by the first side wall, the second side wall and the bottom wall; the top wall defines an opening extending therethrough along the vertical direction and communicating with the receiving space; the lower portion of the connecting mechanism is fixedly received in the receiving space of the accommodating box; the upper portion extends through the opening and beyond the top wall along the vertical direction; and the upper portion is rotatably connected to the end mechanism.

3. The connecting device of claim 2, wherein the upper portion comprises a first upper side wall, a second upper side wall opposite to the first upper side wall, an upper rear wall connecting the first upper side wall and the second upper side wall, and an upper space at least partially formed by the first upper side wall, the second upper side wall and the upper rear wall; the first baffle plate and the second baffle plate reside in the upper space.

4. The connecting device of claim 3, wherein the first baffle plate is located in a height within a range of the height of the second baffle plate along the vertical direction.

5. The connecting device of claim 3, wherein the second baffle plate is U-shaped and comprises a vertical portion, a first horizontal portion integrally extending from an upper end of the vertical portion along the horizontal direction opposite to the first baffle plate, and a second horizontal portion integrally extending from a lower end of the vertical portion along the horizontal direction opposite to the first baffle plate.

6. The connecting device of claim 3, wherein the first baffle plate is integrally formed with the first upper side wall, and the second baffle plate is integrally formed with the upper rear wall.

7. The connecting device of claim 3, wherein the connecting mechanism defines a holding cavity extending through the second upper side wall, the holding cavity communicates with the upper space, and the holding cavity is configured to receive a gear set which is connected to the motor.

8. The connecting device of claim 7, wherein the upper portion is provided with a spring structure to support the end mechanism, the spring structure comprises a locking plate, a rotating shaft and a spring fixedly connected to the rotating shaft, the spring comprises a spring hook abutting against the locking plate, an end of the rotating shaft extends beyond the second upper side wall to be fixedly connected to the end mechanism.

9. The connecting device of claim 3, wherein the lower portion comprises a first lower side wall, a second lower side wall opposite to the first lower side wall, a lower rear wall connecting the first lower side wall and the second lower side wall, and a lower space at least partially formed by the first lower side wall, the second lower side wall and the lower rear wall; the first lower side wall abuts against the first side wall; the second lower side wall abuts against the second side wall.

10. The connecting device of claim 9, wherein the accommodating box comprises at least one fastening post integrally formed with the rear wall, the at least one fastening post extends into the receiving space; the at least one fastening post defines a blind hole; and wherein the lower portion comprises at least one raised block protruding into the lower space, the at least one raised block defines a through hole, the through hole is aligned with the blind hole, and the connecting mechanism is fixed to the accommodating box by a fastening element fixed in the through hole and the blind hole.

11. A positioning device, comprising:

an end mechanism;

an accommodating box disposed under the end mechanism; the end mechanism being rotatable with respect to the accommodating box; the accommodating box comprising a rear wall and a support flange; the support flange comprising a first side wall, a second side wall opposite to the first side wall, a bottom wall connecting the first side wall and the second side wall, and a receiving space at least partially formed by the first side wall, the second side wall and the bottom wall; and a connecting mechanism located between the end mechanism and the accommodating box, the connecting mechanism being at least partially received in the receiving space, the connecting mechanism defining a plurality of through holes;

wherein the accommodating box is provided with a plurality of positioning mechanisms integrally formed with the rear wall, the plurality of positioning mechanisms extend into the receiving space, each positioning mechanism defines a blind hole which is aligned with a corresponding through hole, the connecting mechanism is fixed to the accommodating box by a plurality of fastening elements, and each fastening element is fixed in the blind hole and the corresponding through hole.

12. The positioning device of claim 11, wherein an outer periphery of the positioning mechanism is provided with a plurality of reinforcing ribs at intervals.

13. The positioning device of claim 11, wherein the plurality of reinforcing ribs comprise a first rib and a second rib which are located opposite to each other.

14. The positioning device of claim 10, wherein the accommodating box is provided with a plurality of grid ribs formed on the rear wall and exposed to the receiving space.

15. The positioning device of claim 14, wherein the accommodating box comprises a top wall below which the support flange is located; the top wall defines an opening extending therethrough along a vertical direction and communicating with the receiving space; and the plurality of vertical ribs connect the top wall and the bottom wall.

16. The positioning device of claim 15, wherein the connecting mechanism comprises a lower portion and an upper portion extending from the lower portion along the vertical direction; the lower portion is wider than the upper portion along a horizontal direction perpendicular to the vertical direction; the lower portion of the connecting mechanism is fixedly received in the receiving space of the accommodating box; the upper portion extends through the opening and beyond the top wall along the vertical direction; the upper portion is connected to the end mechanism; and the end mechanism is rotatable with respect to the upper portion.

17. The positioning device of claim 16, wherein the upper portion comprises a first upper side wall, a second upper side wall opposite to the first upper side wall, an upper rear wall connecting the first upper side wall and the second upper side wall, and an upper space at least partially formed by the first upper side wall, the second upper side wall and the upper rear wall;

wherein the lower portion comprises a first lower side wall, a second lower side wall opposite to the first lower side wall, a lower rear wall connecting the first lower side wall and the second lower side wall, and a lower space at least partially formed by the first lower side wall, the second lower side wall and the lower rear wall; the first lower side wall abuts against the first side wall; the second lower side wall abuts against the second side wall.

18. The positioning device of claim 17, wherein the upper portion is provided with a spring structure to support the end mechanism, the spring structure comprises a locking plate, a rotating shaft and a spring fixedly connected to the rotating shaft, the spring comprises a spring hook abutting against the locking plate, an end of the rotating shaft extends beyond the second upper side wall to be fixedly connected to the end mechanism.

19. An intelligent garbage can, comprising:

an end mechanism comprising:

an end cap frame comprising a hollow interior and a horizontal bracket located at a middle portion of the end cap frame, the horizontal bracket comprising a plurality of support bases extending upwardly and a plurality of support feet extending downwardly;

a first member fixed to and disposed above the end cap frame, the first member being at least partially supported by the horizontal bracket, the first member comprising a hollow portion which is configured to install a garbage bag box and a skirt extending downwardly which ensures sealing when the garbage bag box leaves the first member, the first member comprising a plurality of first support feet extending downwardly and supported by the plurality of support bases of the end cap frame; and a second member fixed to and disposed below the end cap frame, the second member comprising a plurality of second support bases to support the support feet of the end cap frame;

an accommodating box disposed under the end mechanism, the end mechanism being rotatable with respect to the accommodating box, the accommodating box comprising a rear wall and a support flange; the support flange comprising a first side wall, a second side wall opposite to the first side wall, a bottom wall connecting the first side wall and the second side wall, and a receiving space at least partially formed by the first side wall, the second side wall and the bottom wall; and a connecting mechanism located between the end mechanism and the accommodating box, the connecting mechanism being at least partially received in the receiving space, the connecting mechanism defining at least one through hole;

wherein the accommodating box is provided with at least one positioning post extending into the receiving space, the positioning post defines a blind hole which is aligned with a corresponding through hole, and the connecting mechanism is fixed to the accommodating box by a fastening element which is secured in the through hole and the blind hole.

20. The intelligent garbage can of claim 19, wherein the accommodating box is provided with a plurality of ventilation holes;

the intelligent garbage can further comprises:

an outer casing provided with a plurality of mesh holes in fluid communication with the plurality of ventilation holes; and a gathering mechanism comprising:

a bellows covering the ventilation holes; and a guide fan disposed above the bellows;

wherein the guide fan comprises a guide impeller and an air outlet channel being tangent to a main body of the guide fan; and wherein the guide impeller is configured to rotate so as to discharge turbid air inside the intelligent garbage can to an outside through the plurality of ventilation holes, the bellows and the plurality of mesh holes.

* * * * *